US008843012B2

(12) United States Patent
Maeda et al.

(10) Patent No.: US 8,843,012 B2
(45) Date of Patent: Sep. 23, 2014

(54) COLOR ELECTROPHOTOGRAPHIC IMAGE FORMING APPARATUS WITH CARTRIDGE SUPPORTING MEMBER AND MOVING MEMBERS SUPPORTING ELECTRIC CONTACTS

(75) Inventors: Masafumi Maeda, Yokohama (JP); Takateru Ohkubo, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 479 days.

(21) Appl. No.: 13/055,500

(22) PCT Filed: Mar. 18, 2009

(86) PCT No.: PCT/JP2009/056017

§ 371 (c)(1),
(2), (4) Date: Jan. 24, 2011

(87) PCT Pub. No.: WO2010/035535

PCT Pub. Date: Apr. 1, 2010

(65) Prior Publication Data

US 2011/0116833 A1 May 19, 2011

(30) Foreign Application Priority Data

Sep. 29, 2008 (JP) ..... 2008-249587
Jan. 29, 2009 (JP) ..... 2009-017478

(51) Int. Cl.

| | |
|---|---|
| ***G03G 15/00*** | (2006.01) |
| ***G03G 21/18*** | (2006.01) |
| ***G03G 15/01*** | (2006.01) |
| ***G03G 21/16*** | (2006.01) |

(52) U.S. Cl.

CPC ..... *G03G 21/1867* (2013.01); *G03G 15/0178* (2013.01); *G03G 2221/1869* (2013.01); *G03G 21/1652* (2013.01); *G03G 21/1871* (2013.01); *G03G 2221/1684* (2013.01); *G03G 21/1842* (2013.01); *G03G 2221/166* (2013.01); *G03G 2215/0125* (2013.01)

USPC ..... 399/90; 399/112; 399/126

(58) Field of Classification Search

USPC ..... 399/90, 112, 126

See application file for complete search history.

(56) References Cited

U.S. PATENT DOCUMENTS

| | | | |
|---|---|---|---|
| 6,922,534 | B2 | 7/2005 | Goto et al. |
| 7,366,455 | B2 | 4/2008 | Iwasaki et al. |

(Continued)

FOREIGN PATENT DOCUMENTS

| | | |
|---|---|---|
| CN | 1743974 | 3/2006 |
| JP | 2003-107838 | 4/2003 |

(Continued)

OTHER PUBLICATIONS

International Preliminary Report on Patentability in PCT/JP2009/056017, issued Apr. 7, 2011.

(Continued)

*Primary Examiner* — Joseph S Wong

(74) *Attorney, Agent, or Firm* — Fitzpatrick, Cella, Harper & Scinto

(57) ABSTRACT

A color image forming apparatus to which a plurality of cartridges are detachably mounted, including: main body side positioning portions provided on an apparatus main body; a cartridge supporting member detachably supporting the cartridges having cartridge side electric contacts and cartridge side positioned portions, and movable among a first position for forming images, a second position retracted from the first position, and a third position where the cartridges are pulled out of the main body; a pressing member pressing the positioned portions on the positioning portions; and main body side electric contacts provided on the main body, wherein the electric contacts are directly and electrically connected to the electric contacts when the positioned portions are pressed on the positioning portions by the pressing member.

7 Claims, 19 Drawing Sheets

(56) References Cited

U.S. PATENT DOCUMENTS

| | | | | |
|---|---|---|---|---|
| 7,711,282 | B2 | 5/2010 | Okabe | |
| 7,715,746 | B2 | 5/2010 | Tanabe et al. | |
| 7,715,752 | B2 | 5/2010 | Sakurai et al. | |
| 7,773,905 | B2 | 8/2010 | Kuruma | |
| 2007/0286632 | A1* | 12/2007 | Okabe | 399/90 |
| 2008/0159772 | A1 | 7/2008 | Koishi et al. | |
| 2008/0159773 | A1 | 7/2008 | Murayama et al. | |
| 2008/0159774 | A1 | 7/2008 | Tanabe et al. | |

FOREIGN PATENT DOCUMENTS

| | | |
|---|---|---|
| JP | 2007-093830 | 4/2007 |
| JP | 2007-213033 | 8/2007 |
| JP | 2008-165025 | 6/2008 |
| JP | 2008-165026 | 7/2008 |
| JP | 2008-276117 | 11/2008 |

OTHER PUBLICATIONS

Office Action in Chinese Patent Application No. 200980137331.7, mailed Sep. 20, 2012 (with English translation).

Partial English translation of May 8, 2009 Office Action in Japanese Application No. 0068631-01.

Office Action in Russian Patent Application No. 2011117169, mailed May 18, 2012 (with excerpt English translation).

Office Action in Chinese Patent Application No. 200980137331.7, dated Feb. 18, 2014 (with English translation).

Office Action in Russian Patent Application No. 2013105448/28, mailed Apr. 1, 2014 (with English translation).

Official Action dated Apr. 23, 2014, issued in counterpart Chinese Patent Application No. 201310045070.4 (with an English translation).

* cited by examiner

COLOR ELECTROPHOTOGRAPHIC IMAGE FORMING APPARATUS WITH CARTRIDGE SUPPORTING MEMBER AND MOVING MEMBERS SUPPORTING ELECTRIC CONTACTS

TECHNICAL FIELD

The present invention relates to a color electrophotographic image forming apparatus, in which a plurality of cartridges are detachably mounted to an apparatus main body to form an image on a recording medium.

Here, the color electrophotographic image forming apparatus forms a color image on a recording medium by using an electrophotographic image forming process. Then, examples of the color electrophotographic image forming apparatus include, for example, a color electrophotographic copying machine, a color electrophotographic printer (for example, such as a color laser beam printer and a color LED printer), a color facsimile machine, and a color word processor.

Besides, the recording medium is one on which an image is formed by the electrophotographic image forming apparatus, and paper, an OHP sheet, and the like are included therein, for instance.

Further, a cartridge is, for example, a process cartridge or a developing cartridge, and contributes, under a state being detachably mounted to a main body of the electrophotographic image forming apparatus, to an image forming process for forming the image on the recording medium. Here, in the above-mentioned process cartridge, at least one of a charging means, a developing means, and a cleaning means each serving as a process means and an electrophotographic photosensitive drum are integrated into a cartridge, and the thus formed cartridge is detachably mounted to the main body of the electrophotographic image forming apparatus. Therefore, a process cartridge, in which the developing means serving as the process means and the electrophotographic photosensitive drum are integrated into a cartridge, and the thus formed cartridge is detachably mounted to the main body of the electrophotographic image forming apparatus, is also included in the above-mentioned process cartridge. In addition, a process cartridge, in which the charging means, the developing means, or the cleaning means each serving as the process means and the electrophotographic photosensitive drum are integrated into a cartridge, and the thus formed cartridge is detachably mounted to the main body, is also included in the above-mentioned process cartridge. Note that, the process cartridge, which integrally includes the electrophotographic photosensitive drum and the developing means, is referred to as a so-called integral type. Further, the process cartridge, which integrally includes the electrophotographic photosensitive drum and the process means other than the developing means, is referred to as a so-called separation type. Further, the cartridge having a developing means is hereinafter referred to as a developing cartridge.

Further, the developing cartridge refers to one, which includes a developing roller, contains a developer (toner) used to develop an electrostatic latent image formed on the electrophotographic photosensitive drum by the developing roller, and is detachably mounted to the main body. In a case of the developing cartridge, the electrophotographic photosensitive drum is mounted to the apparatus main body or a cartridge supporting member described below. Alternatively, the electrophotographic photosensitive drum is provided in the so-called separation type process cartridge (in this case, the process cartridge has no developing means). Note that, the developing cartridge also allows mounting and detaching to and from the image forming apparatus main body by the user himself. For that reason, the maintenance of the apparatus main body can easily be performed.

Then, as the cartridge, the so-called integral type or the so-called separation type process cartridge may be used. Further, as the cartridge, the so-called separation type process cartridge and the developing cartridge may be used as a pair. Further, there may be included a case in which, as the cartridge, the electrophotographic photosensitive drum is fixed and mounted to the apparatus main body or the cartridge supporting member described below, and the developing cartridge is detachably mounted so as to be capable of acting on the electrophotographic photosensitive drum.

Here, the process cartridge and the developing cartridge can be mounted to and detached from the main body of the image forming apparatus by the user him/herself. Therefore, such an apparatus main body can be maintained easily. Note that the process means acts on the electrophotographic photosensitive drum.

Further, the apparatus main body of the electrophotographic image forming apparatus is a portion of the electrophotographic image forming apparatus excluding the above-mentioned cartridges.

BACKGROUND ART

U.S. Patent Application Publication No. 2008/0159773 describes a color electrophotographic image forming apparatus that forms a color image on a recording medium, in which a plurality of cartridges are detachably mounted to an apparatus main body. The electrophotographic image forming apparatus includes a cartridge supporting member that supports the cartridges and moves between an inside position of being located in the apparatus main body and a pulled-out position of being pulled out to the outside of the apparatus main body. In the electrophotographic image forming apparatus, when the cartridges and the apparatus main body are electrically connected to each other, electric contacts provided on the cartridge supporting member are interposed therebetween. According to such a construction, the cartridges and the apparatus main body can be surely connected electrically to each other.

DISCLOSURE OF THE INVENTION

The present invention has further developed the conventional art described above.

It is an object of the present invention to provide a color electrophotographic image forming apparatus capable of electrically connecting the cartridges and the main body to each other without providing intermediate electric contacts on the cartridge supporting member.

It is another object of the present invention to provide a color electrophotographic image forming apparatus capable of electrically connecting cartridge side electric contacts and main body side electric contacts to each other without providing the intermediate electric contacts on the cartridge supporting member.

It is another object of the present invention to provide a color electrophotographic image forming apparatus capable of electrically connecting the cartridges and the main body to each other while suppressing an increase of the number of components.

It is another object of the present invention to provide a color electrophotographic image forming apparatus capable of surely connecting the cartridges and the main body electrically to each other.

In order to achieve the above-mentioned object, in the representative structure of the present invention, a color electrophotographic image forming apparatus to which a plurality of cartridges are detachably mounted to form a color image on a recording medium includes:

main body side positioning portions provided on a main body of the color electrophotographic image forming apparatus for the plurality of cartridges, respectively;

a cartridge supporting member movable between an inside portion of the main body and an outside position of the main body in a state of detachably supporting the plurality of cartridges including cartridge side electric contacts and cartridge side positioned portions, the cartridge supporting member moving among a first position where the plurality of cartridges are located at an image forming position at which the plurality of cartridges form images at the inside position, a second position where the plurality of cartridges are retracted from the first position at the inside position, and a third position where the plurality of cartridges are pulled out from the main body and are located at the outside position;

a pressing member that presses the plurality of cartridges in association with a movement operation of the cartridge supporting member from the second position to the first position so as to press the cartridge side positioned portions onto the main body side positioning portions; and main body side electric contacts provided on the main body for the plurality of cartridges, respectively, the main body side electric contacts being electrically connected to the cartridge side electric contacts by a movement of the cartridge supporting member from the second position to the first position, wherein, in a state in which the cartridge side positioned portions are pressed on the main body side positioning portions by a pressing force of the pressing member, the cartridge side electric contacts are directly and electrically connected to the main body side electric contacts so that the main body and the plurality of cartridges are electrically connected to each other.

According to the present invention, the cartridges and the main body can be electrically connected to each other without providing intermediate electric contacts on the cartridge supporting member.

According to the present invention, the cartridge side electric contacts and the main body side electric contacts can be electrically connected to each other without providing intermediate electric contacts on the cartridge supporting member.

According to the present invention, the cartridges and the main body can be electrically connected to each other while suppressing an increase of the number of components.

According to the present invention, the cartridges and the main body can be surely connected electrically to each other.

BEST MODES FOR CARRYING OUT THE INVENTION

First Embodiment

An embodiment of an electrophotographic image forming apparatus will be described below with reference to the drawings.

Note that the embodiment will be described by taking an integral-type process cartridge as an example of a cartridge.

However, in the present invention, the cartridge is not limited to the integral-type process cartridge.

(Entire Construction of Color Electrophotographic Image Forming Apparatus)

Figure 1:
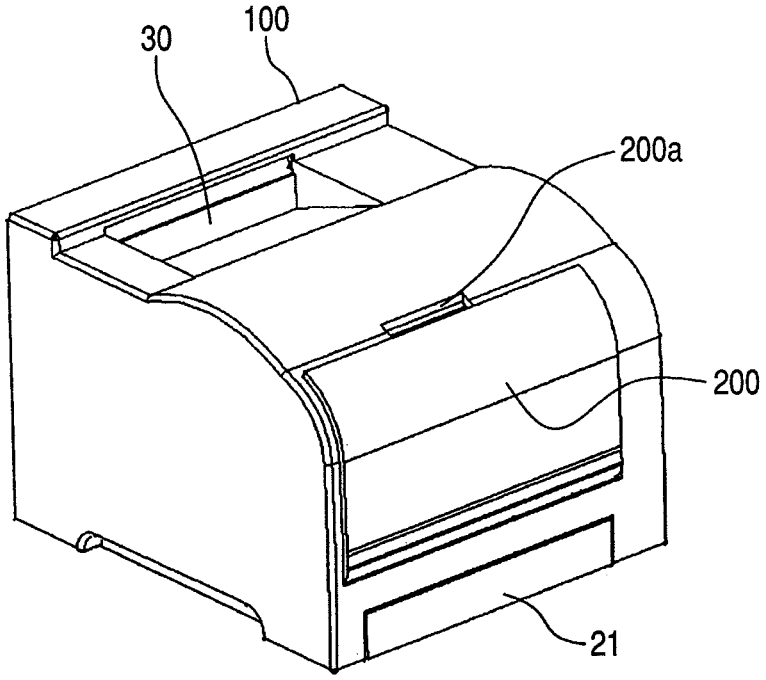
FIG. 1 is an exterior appearance perspective view of an image forming apparatus.
Figure 2:
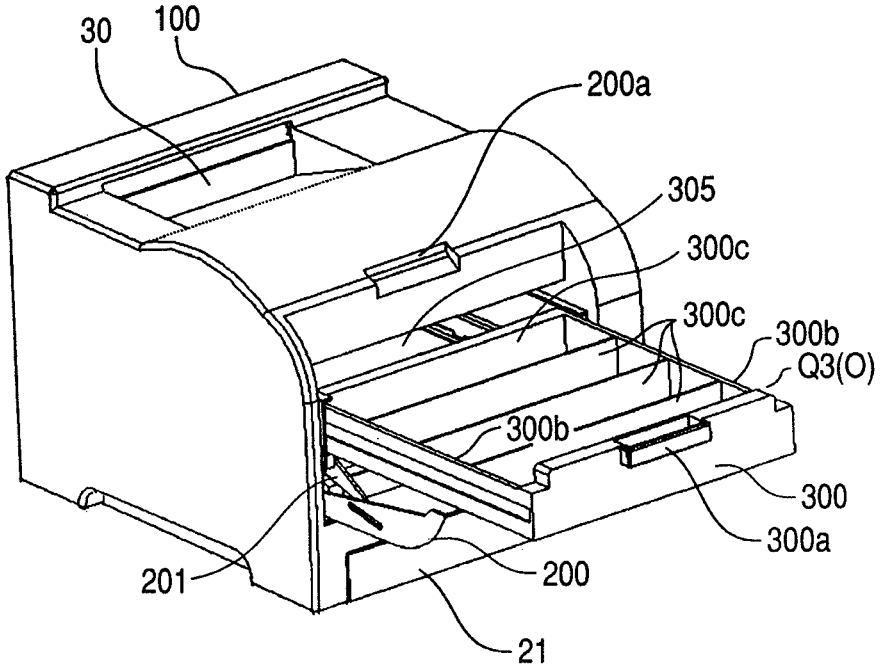
FIG. 2 is an exterior appearance perspective view of the image forming apparatus, which is opened.
Figure 3:
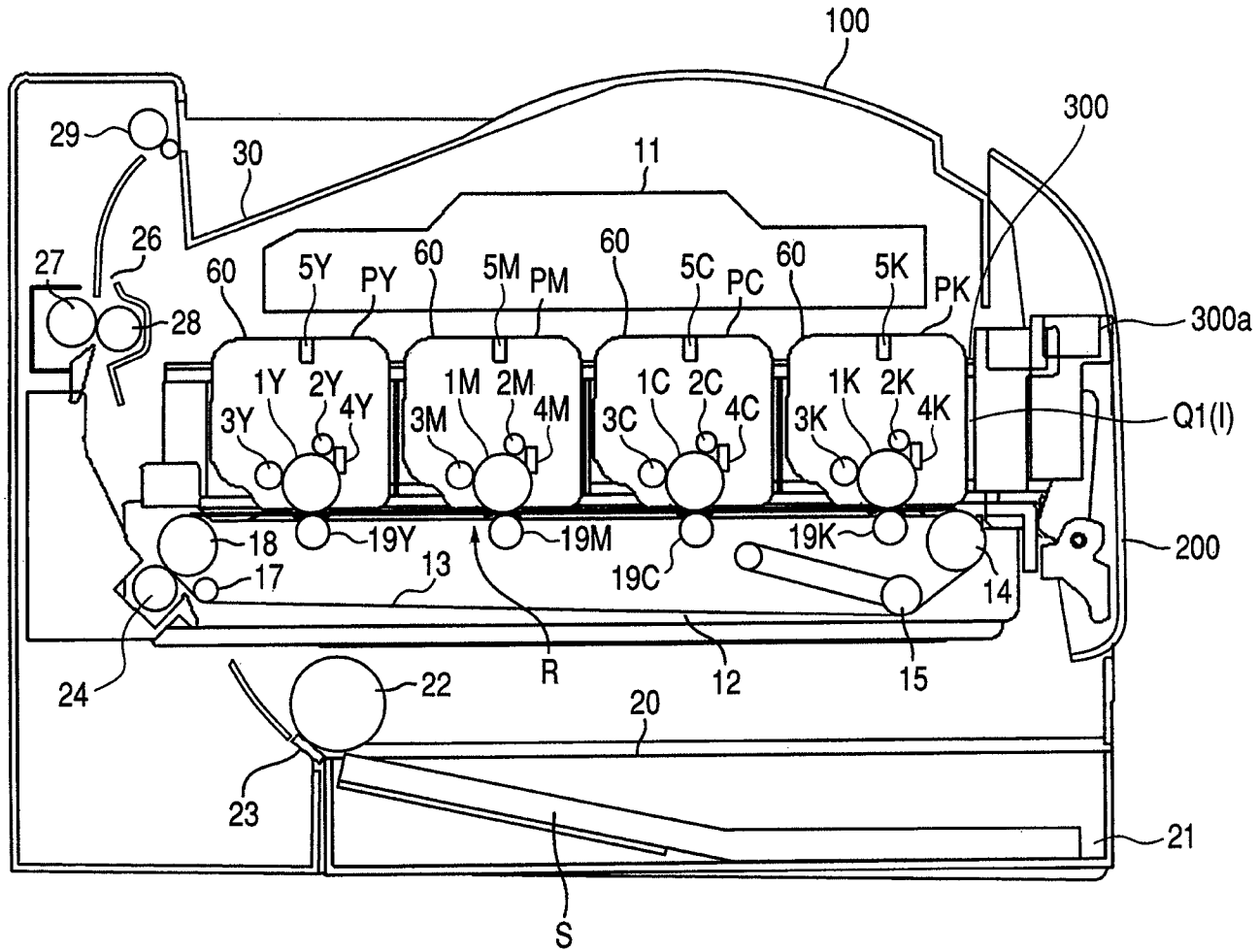
FIG. 3 is a cross-sectional view of the image forming apparatus.

First, an entire construction of a color electrophotographic image forming apparatus (hereinafter, referred to as an image forming apparatus) will be described with reference to FIGS. 1, 2 and 3. FIGS. 1 and 2 are exterior perspective views and FIG. 3 is a cross-sectional view of an image forming apparatus 100 according to this embodiment. Here, as the electrophotographic image forming apparatus, there is exemplified a four-full-color laser printer using an electrophotographic process. The printer conducts an image formation with respect to a recording medium S (hereinafter, referred to as a sheet) on the basis of an electrical image signal input from an external host apparatus (not shown) such as a personal computer, an image reader, a facsimile at the other end, and the like. Note that, the color electrophotographic image forming apparatus described below forms a color image on the recording medium S with a plurality of cartridges P being detachably mounted.

In the following description, an apparatus main body (hereinafter, referred to as a main body) of the image forming apparatus is a portion of the image forming apparatus excluding the process cartridge (hereinafter, referred to as a cartridge). Further, with regard to the image forming apparatus, a front side (front surface side) of the main body is a side on which an openable and closable door (openable and closable member) 200 is disposed. A rear side refers to an opposite side thereto. A front-rear direction refers to a direction from the rear side toward the front side of the image forming apparatus (forward direction), and an opposite direction thereto (rear direction). A left or a right refers to a left or a right when the main body is viewed from the front side. A lateral direction refers to a direction from right toward left (left-hand direction) and an opposite direction thereto (right-hand direction).

In the main body 100, from the rear side toward the front side, first to fourth cartridges P (PY, PM, PC, PK), four in total, are arranged in line in the horizontal direction. The respective cartridges P have constructions similar to one another except that colors of developers (hereinafter, referred to as toners) contained therein are different from one another. Each of the cartridges P (PY, PM, PC, PK) of this embodiment has the following construction. Specifically, an electrophotographic photosensitive drum 1 (1Y, 1M, 1C, 1K) (hereinafter, referred to as a drum), a charging means 2 (2Y, 2M, 2C, 2K), a developing means 3 (3Y, 3M, 3C, 3K) and a cleaning means 4 (4Y, 4M, 4C, 4K) are integrally assembled in a cartridge frame 60. Here, the charging means 2, the developing means 3 and the cleaning means 4 serve as process means which act on the drum 1. Each of the cartridges P is detachably mounted to the main body 100 by a user. Each of the charging rollers 2 (2Y, 2M, 2C, 2K) as the charging means is a contact charging roller. The charging roller 2 charges the drum 1 with the charging roller 2 being in contact with the drum 1. Each of the developing means 3 is a developing roller that develops an electrostatic latent image, which is formed on the drum 1, by using the toner contained in a developer container. Each of the cleaning means 4 is a blade-type one. The cleaning means 4 is a cleaning blade that removes the toner remaining on a surface of the drum 1 after transfer. As described above, the developing rollers are denotes by reference symbols 3 (3Y, 3M, 3C, 3K), and the cleaning blades are denoted by reference symbols 4 (4Y, 4M, 4C, 4K).

The first cartridge PY contains the toner of yellow (Y) color, and forms a toner image of the yellow color on the surface of the drum 1 by the developing roller 3Y. The second cartridge PM contains the toner of magenta (M) color, and forms a toner image of the magenta color on the surface of the drum 1 by the developing roller 3M. The third cartridge PC contains the toner of cyan (C) color, and forms a toner image of the cyan color on the surface of the drum 1 by the developing roller 3C. The fourth cartridge PK contains the toner of black (K) color, and forms a toner image of the black color on the surface of the drum 1 by the developing roller 3K.

Above the respective cartridges P attached to the main body, a laser scanner unit 11 is disposed. The unit 11 outputs laser beams modulated in response to image information of the respective colors, which is input from an external host apparatus (not shown), and exposes the surfaces of the drums 1 of the respective cartridges P through exposure apertures 5 (5Y, 5M, 5C, 5K) provided in upper surfaces of the cartridge frames 60.

Below the respective cartridges P, an intermediate transfer belt unit 12 is provided. The belt unit 12 includes: an endless belt 13 as an intermediate transfer member, which is made of a dielectric and has flexibility; and a drive roller 14, a tension roller 15, a turn roller 17, and a secondary transferring opposite roller 18, around which the belt 13 wraps and stretches so as to be circularly moved. The drive roller 14 and the tension roller 15 are arranged on the front side in the main body 100. The turn roller 17 and the roller 18 are arranged on the rear side in the main body 100. Lower surfaces of the drums 1 of the respective cartridges P are in contact with an upper surface of the belt 13. In an inside of the belt 13, four primary transferring rollers 19 (19Y, 19M, 19C, 19K) are provided oppositely to the drums 1 of the respective cartridges P while interposing portions of the belt 13 therebetween. A transferring roller 24 is made to abut on the roller 18 while interposing the belt 13 therebetween.

A feed unit 20 is provided below the belt unit 12. The feed unit 20 includes a feed tray 21, a feed roller 22, and a separation pad 23. The tray 21 is freely pulled out from the main body 100 from the front side thereof, and is freely pushed into from the front side.

In an upper portion of the rear side in the main body 100, a fixing device 26 and a delivery roller pair 29 are provided. A delivery tray 30 is provided on an upper surface of the main body 100. The fixing device 26 includes a fixing film assembly 28 and a pressure roller 27.

In the main body 100, the respective cartridges P mounted at an image forming position R where the images are formed are positioned to the main body 100 in a state (described later) of being fixed at predetermined positions. Further, drive output portions (not shown) provided on the main body 100 are coupled to drive input portions (not shown) of the respective cartridges P. In such a way, rotational force is transmitted from the main body 100 to each of the cartridges P. Further, cartridge side electric contacts 500S of the cartridges P and main body side electric contacts 500H provided on the main body 100 are in direct contact with each other, and are electrically connected to each other. In such a way, a bias (power) is supplied from the main body 100 to each of the cartridges P.

An operation for forming a full-color image is as follows. The respective drums 1 of the first to fourth cartridges P are rotated in a counterclockwise direction at predetermined speed. The belt 13 is also rotated in a clockwise direction (forward direction with respect to drum rotation) at a speed corresponding to a speed of the drum 1. The laser scanner unit 11 is also driven. In synchronism with the drive, in the respective cartridges P, the charging roller 2 uniformly charges the surface of the drum 1 to a predetermined polarity and predetermined potential at each predetermined control timing. The laser scanner unit 11 exposes laser beams on the surfaces of the respective drums 1 in accordance with corresponding image signals. With this operation, electrostatic latent images are formed on the surfaces of the respective drums 1 in accordance with the corresponding image signals of corresponding colors. The electrostatic latent images formed on the drums 1 are developed with the developing means 3, whereby the toner images are formed.

With the above-mentioned electrophotographic image forming process operation, on the drum 1Y of the first cartridge PY, a yellow toner image corresponding to a yellow component of a full-color image is formed. Then, the toner image is primarily transferred onto the belt 13.

On the drum 1M of the second cartridge PM, a magenta toner image corresponding to a magenta component of the full color image is formed. Then, the toner image is primarily transferred onto the belt 13 while being superimposed on the toner image of the yellow color, which has already been transferred onto the belt 13.

On the drum 1C of the third cartridge PC, a cyan toner image corresponding to a cyan component of the full color image is formed. Then, the toner image is primarily transferred onto the belt 13 while being superimposed on the toner images of the yellow color and the magenta color, which have already been transferred onto the belt 13.

On the drum 1K of the fourth cartridge PK, a black toner image corresponding to a black component of the full color image is formed. Then, the toner image is primarily transferred onto the belt 13 while being superimposed on the toner images of the yellow color, the magenta color, and the cyan color, which have already transferred onto the belt 13.

In such a way, an unfixed toner image of the full color is formed on the belt 13. The full color image is made of four colors, which are the yellow color, the magenta color, the cyan color, and the black color.

In each of the cartridges P, residual toner that remains on the surface of the drum 1 after the toner image is primarily transferred onto the belt 13 is removed by the cleaning means 4.

Meanwhile, the feed roller 22 is rotated at predetermined control timing. In such a way, one piece of recoding mediums (a sheet of paper) S stacked on the feed tray 21 is separated therefrom and fed by cooperation between the feed roller 22 and the separation pad 23. Such a fed recording medium S is introduced into a nip portion (secondary transferring nip portion) between the secondary transferring roller 24 and the belt 13. In such a way, the four color superposed toner images on the belt 13 are transferred in a lump onto the recording medium S in a process where the recording medium S is nipped by the nip portion and is conveyed therethrough.

The recording medium S is separated from the surface of the belt 13 so as to be introduced into the fixing device 26, and is then heated/pressurized by a fixing nip portion. In such a way, the toner images of the respective colors are subjected to color mixing and are fixed to the recording medium S. Then, the recording medium S on which the full color image is formed passes through the fixing device 26, and is discharged to the delivery tray 30 by the delivery roller pair 29.

In the case of this embodiment, the toner that remains on the surface of the belt 13 after the recording medium S is separated therefrom adheres electrostatically to the surface of the drum 1, for example, in such a primary transferring portion of the first process cartridge PY. Then, such residual toner is removed from the surface of the drum 1 by the cleaning means 4.

(Exchange Method of Cartridge)

Figure 4:
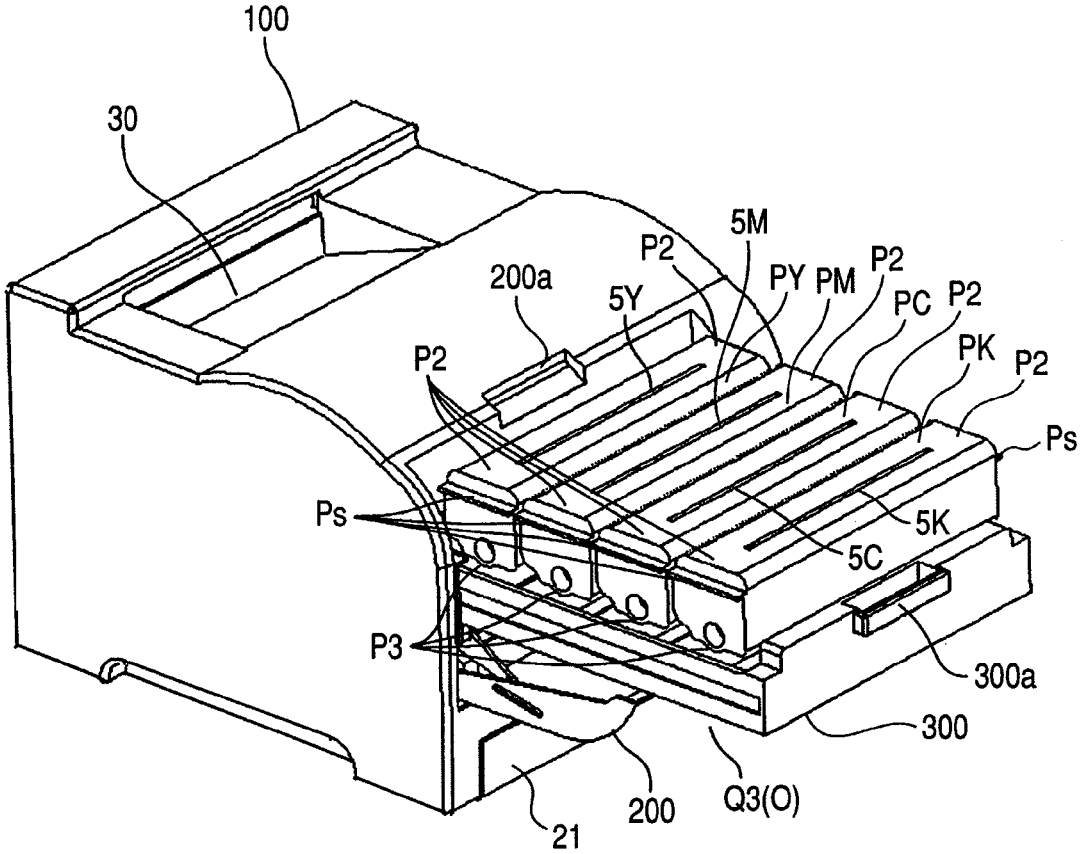
FIG. 4 is an exterior appearance perspective view illustrating a state in which cartridges are attached to the image forming apparatus.
Figure 5:
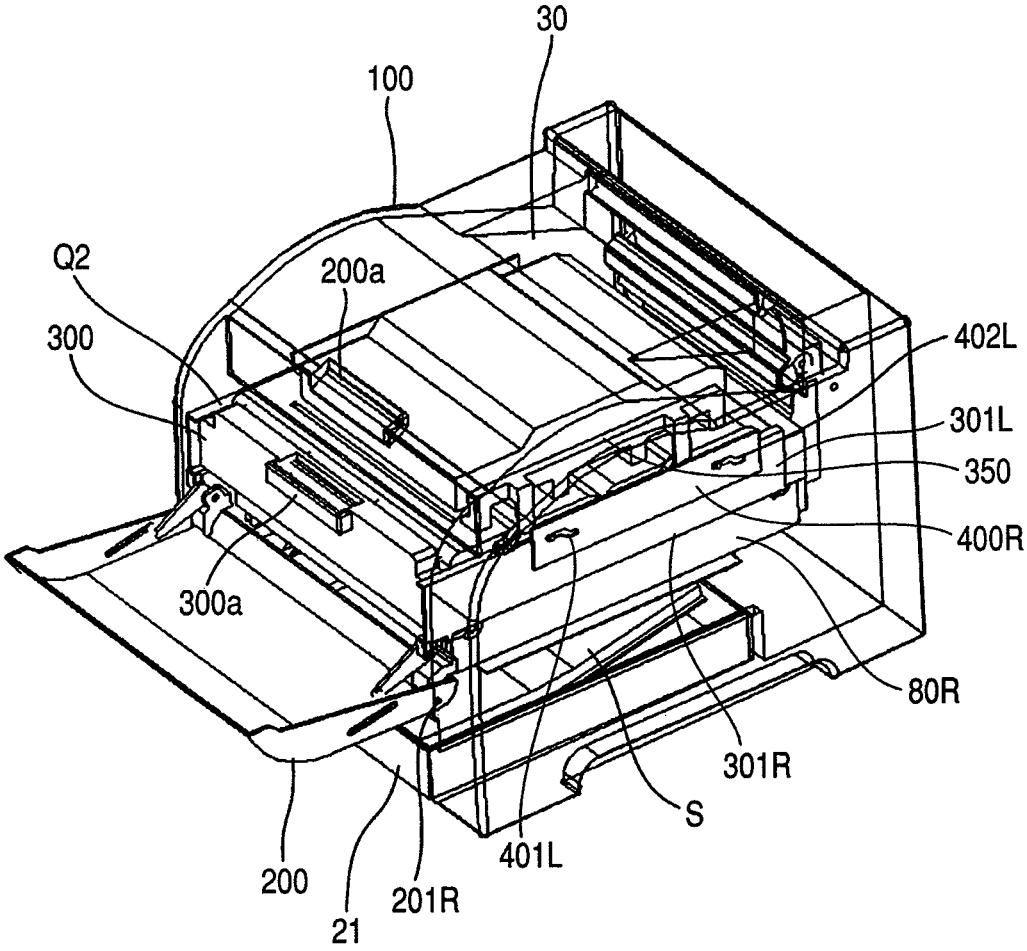
FIG. 5 is an exterior appearance perspective view illustrating a state in which the cartridges are pressed on the image forming apparatus.
Figure 6A:
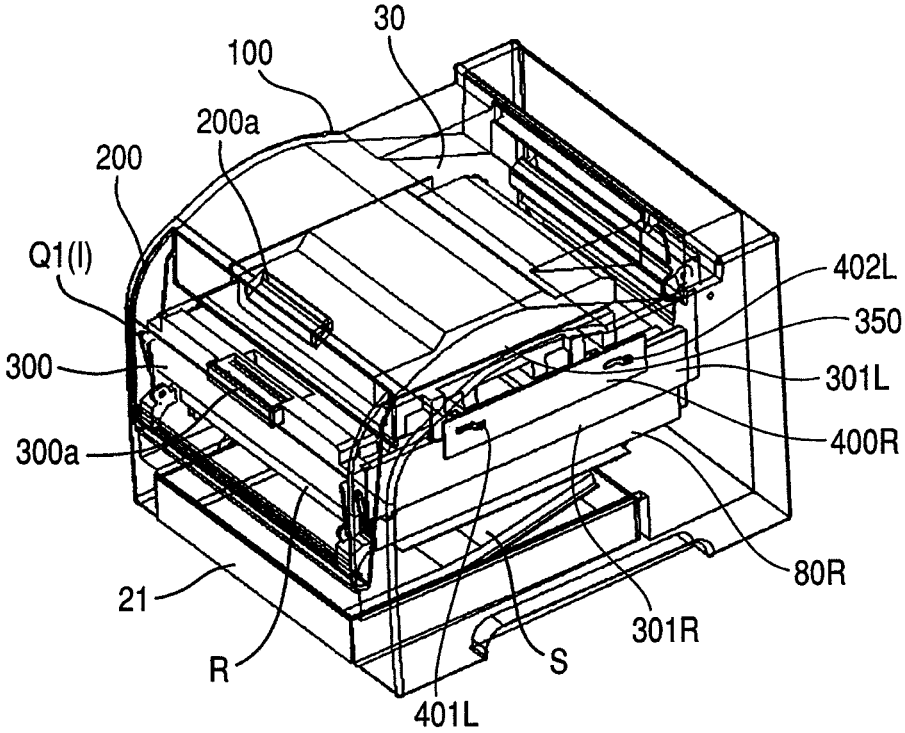
FIG. 6A is an exterior appearance perspective view.
Figure 6B:
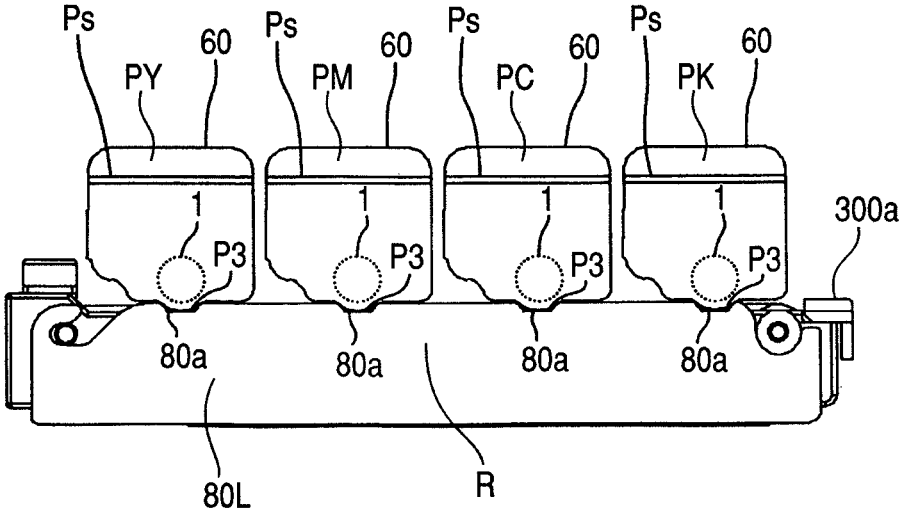
FIG. 6B is a side view, illustrating a state in which the cartridges are pressed on the image forming apparatus.
Figure 7A:
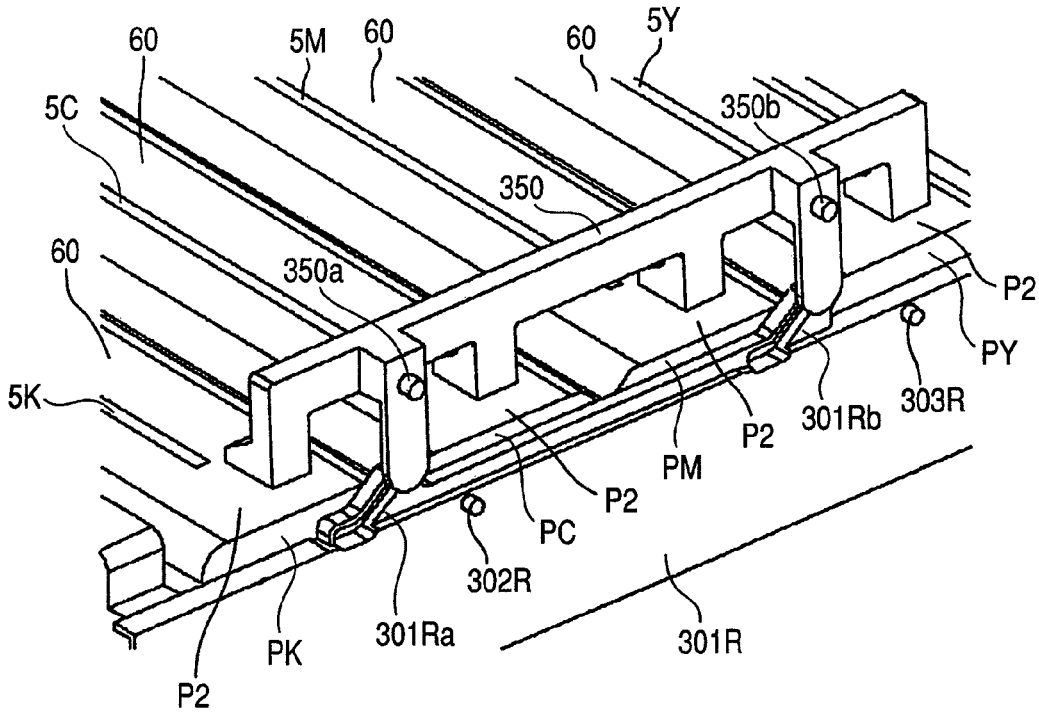
FIGS. 7A and 7B are enlarged perspective views, illustrating a periphery of a pressing member that presses the cartridges on the image forming apparatus.
Figure 9:
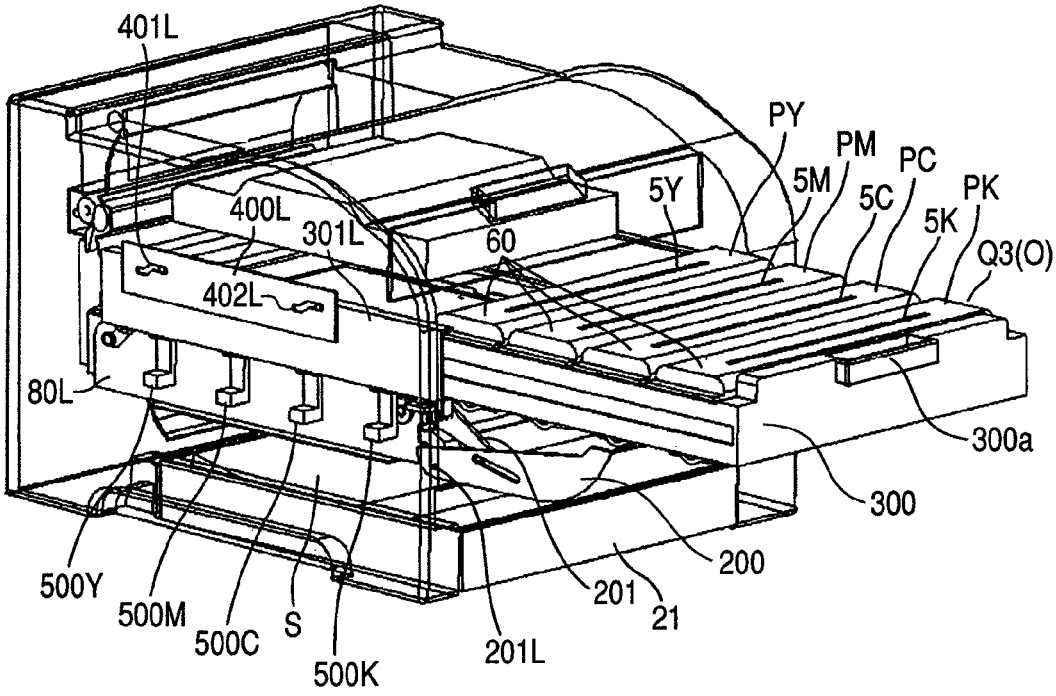
FIG. 9 is a perspective view illustrating a state in which the cartridges are attached to an image forming apparatus according to a first embodiment of the present invention.
Figure 10:
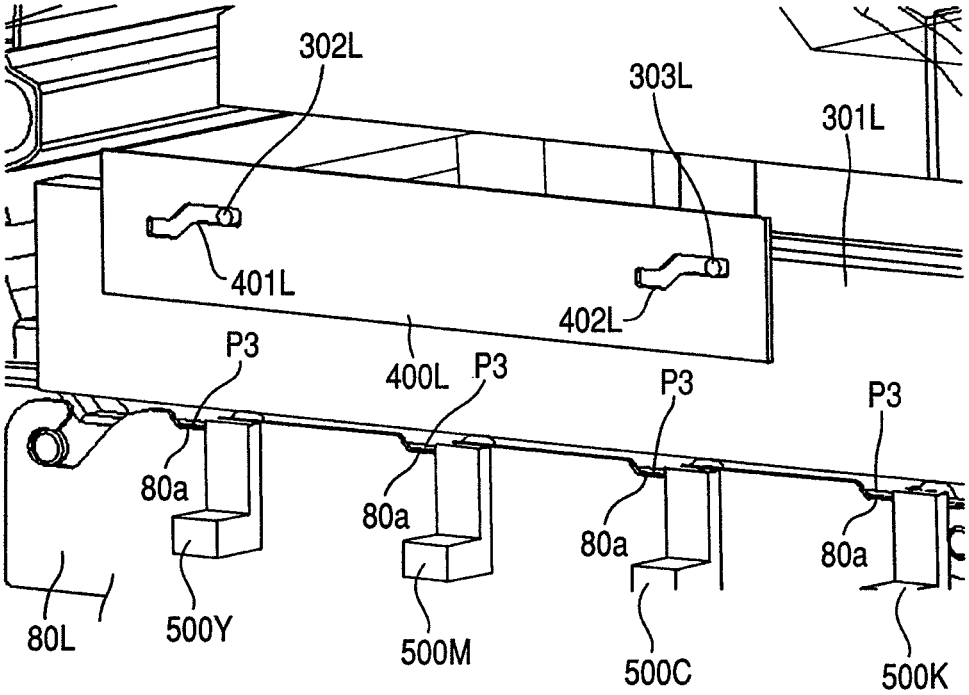
FIG. 10 is an enlarged perspective view of guide portions and electric contacts of the image forming apparatus according to the first embodiment.
Figure 11:
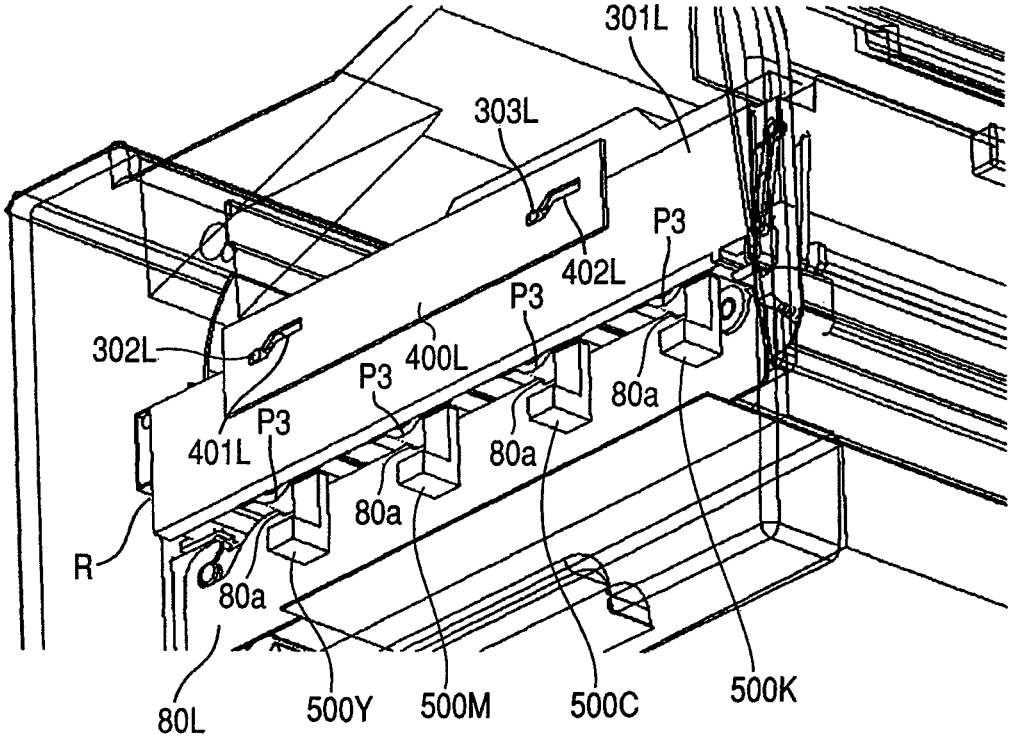
FIG. 11 is an enlarged perspective view of the guide portions and electric contacts of the image forming apparatus according to the first embodiment.
Figure 12A:
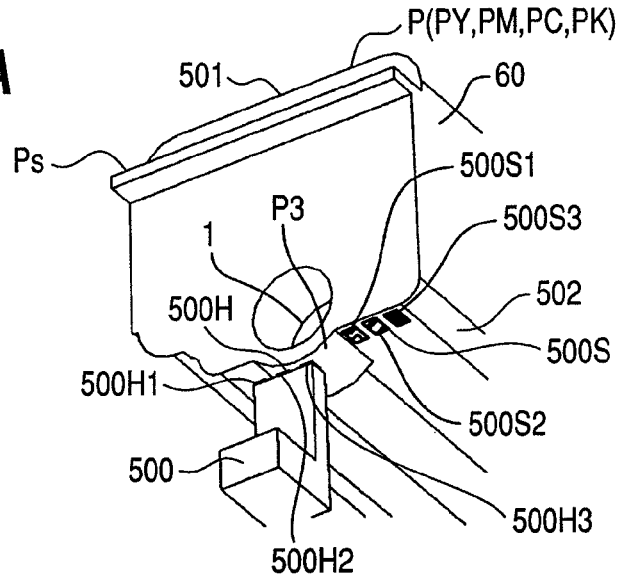
FIGS. 12A, 12B and 12C are partially enlarged perspective views illustrating a state in which cartridge side electric contacts and main body side electric contacts according to the first embodiment are spaced from each other.
Figure 12B:
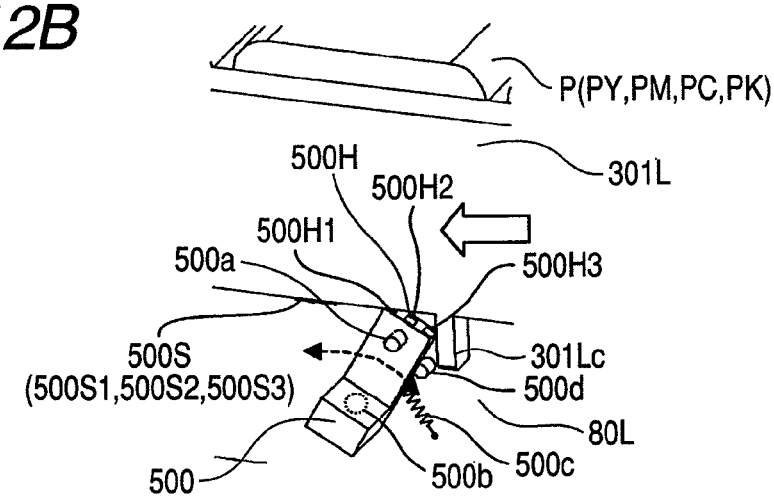
Figure 12C:
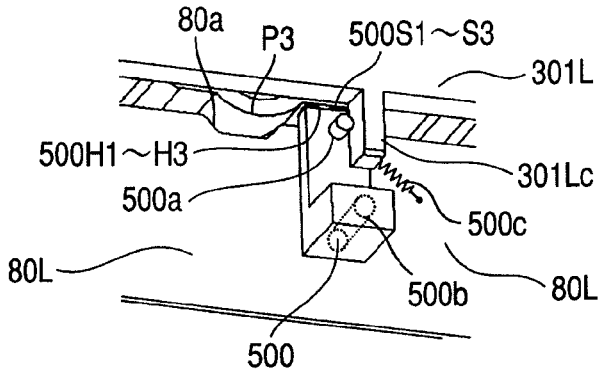
Figure 13:
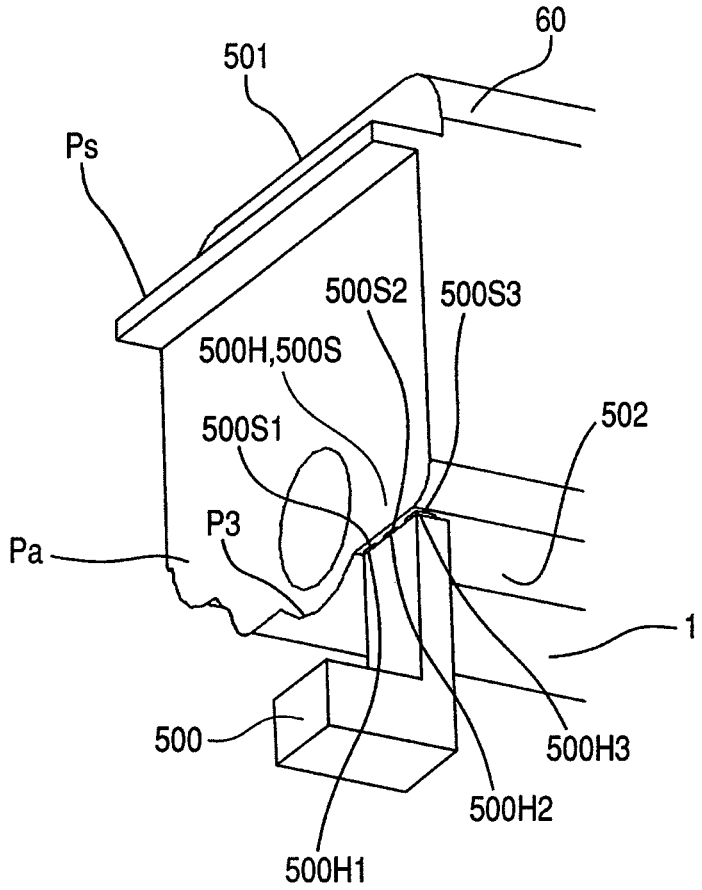
FIG. 13 is a partially enlarged perspective view illustrating a state in which the cartridge side electric contacts and the main body side electric contacts according to the first embodiment are in contact with each other.

Next, an exchange method of the cartridges is described with reference to FIG. 4 to FIG. 13. FIG. 4 is an exterior appearance perspective view illustrating a state where the cartridges are attached to the image forming apparatus. FIG. 5 and FIG. 6A are exterior appearance perspective views of a state where the cartridges are pressed on the image forming apparatus. FIG. 6B is a side view. FIG. 7A to FIG. 8 are enlarged detailed perspective views of a periphery of a pressing member that presses the cartridges. FIG. 9 is a perspective view illustrating a state where the cartridges are attached to the image forming apparatus according to the first embodiment. FIG. 10 and FIG. 11 are partially enlarged perspective views of guide portions and electric contacts of the image forming apparatus according to the first embodiment. FIGS. 12A to 12C are partially enlarged perspective views illustrating a state where cartridge side electric contacts and main body side electric contacts according to the first embodiment are spaced from each other. FIG. 13 is a partially enlarged perspective view illustrating a state where the cartridge side electric contacts and the main body side electric contacts according to the first embodiment are in direct contact with each other.

In each of the first to fourth cartridges PY, PM, PC, and PK, the toner (developer) contained in the developing means 3 is consumed as being used for the image formation.

In this connection, for example, a sensing means (not shown) that senses a residual amount of the toner is provided in each of the cartridges P. Then, a control unit (not shown) provided in the main body 100 is allowed to compare a value of the sensed residual amount, which corresponds to an electrical signal from the sensing means, with a preset threshold value for issuing an advance notice on an end of a lifetime of the cartridge and an alarm about the end of the lifetime. Then, for the cartridge in which the value of the sensed residual amount becomes smaller than the threshold value, the control unit displays, on a display unit (not shown) provided on the main body 100, the advance notice on the end of the lifetime or the alarm about the end of the lifetime for the cartridge. In such a way, the user is prompted to prepare a cartridge as a replacement, or to exchange the cartridge, whereby quality of an output image is maintained. Note that such a sensing mechanism for the residual amount of the toner may be omitted. In this case, the user looks at the image formed on the recording medium S, and thereby determines whether the residual amount of the toner is little.

In order to enhance usability, in the image forming apparatus of this embodiment, for the exchange of each of the cartridges P, the user can open the openable and closable door (openable and closable member) 200 as illustrated in FIG. 5. Then, the user pulls out the cartridges P while keeping the cartridges P mounted on a cartridge tray (cartridge supporting member) 300. From the pulled-out tray 300, the user takes out the cartridge P to be exchanged. After that, the user attaches (supports) a new cartridge P to (on) the tray 300. In such a way, the user exchanges the cartridge P in a front-access manner. Note that supported portions Ps of the respective cartridges P are arranged on both ends in the longitudinal direction of the cartridges P (FIG. 4, FIG. 6B, FIG. 9, and FIG. 12A). The supported portions Ps of the cartridges P are supported on edges 300*b* (FIG. 2) of the tray 300. In such a way, the cartridges P are detachably supported on (attached to) the tray 300. Note that partitions 300*c* (FIG. 2) are provided in the tray 300, and the cartridges are individually supported in spaces partitioned by the partitions 300*c*. Note that nothing is provided under the tray 300, and lower portions of the cartridges P supported in the tray 300 protrude downward from a lower side of the tray 300.

As illustrated in FIG. 4, the tray 300 is the cartridge supporting member movably provided on the main body 100 in a state of detachably supporting the respective cartridges P. In the state of supporting the respective cartridges P, the tray 300 is movable between an inside position I in the main body 100 and an outside position O outside the main body 100. Further, the tray 300 can take a first position Q1 (refer to FIG. 3, FIG. 6A, FIG. 6B, FIG. 19A, and FIG. 19B), a second position Q2 (refer to FIG. 5, FIG. 18A, and FIG. 18B), and a third position Q3 (refer to FIG. 2, FIG. 4, and FIG. 9). Here, the first position Q1 is a position where the cartridges P are located at the image forming position R at which the cartridges P form the images at the inside position I. The second position Q2 is a position where the cartridges P are retracted from the first position Q1 at the inside position I. Further, the third position Q3 is a position where the cartridges P are pulled out from the main body 100 and are located at the outside position O. Specifically, the tray 300 (cartridge supporting member) is provided movably between the inside position I in the main body 100 and the outside position O outside the main body 100 in the state of detachably supporting the plurality of cartridges P. Further, the tray 300 moves between the first position Q1 where the cartridges P are located at the image forming position R at which the cartridges P form the images at the inside position I and the second position Q2 where the cartridges P are retracted from the first position Q1 at the inside position I. Further, the tray 300 moves to the third position Q3 where the cartridges P are pulled out from the main body 100 and are located at the outside position O. The tray 300 linearly moves among the first position Q1, the second position Q2, and the third position Q3. Further, the first position Q1 is a position where the cartridges P are positioned to the main body 100 in the inside of the main body 100. In actual, the cartridges P are positioned by being elastically urged by a pressing member 350 (described later). In a state in which the tray 300 is located at the first position Q1, the cartridges P are positioned at the image forming position R where the cartridges P form the images (refer to FIG. 3, FIG. 6A, and FIG. 6B). In this embodiment, the image forming position R is a position where the lower surfaces of the drums 1 (1Y, 1M, 1C, 1K) are in contact with the belt 13. Further, the second position Q2 is a retracted position where the cartridges P are retracted upward and slightly forward in comparison with the case of being located at the image forming position R in the inside of the main body 100 (refer to FIG. 5). Specifically, the second position Q2 is a position where the tray 300 moves upward and slightly forward with respect to the first position Q1. In a state in which the tray 300 is located at the second position Q2, the lower surfaces of the drums 1 are spaced from the belt 13. Further, the third position Q3 is a position where the tray 300 is pulled out from the second position Q2 to the outside of the main body 100, and is also a position where the cartridges P are mountable to and detachable from the tray 300 (refer to FIG. 4 and FIG. 9). Note that, in the following description, the first position Q1 is referred to as the image forming position, the second position Q2 is referred to as a mounting position, and the third position Q3 is referred to as a pulling-out position. Incidentally, the image forming position of the cartridges P is denoted by the reference symbol R.

As illustrated in FIG. 5 and FIG. 9, the tray 300 is supported by a left and right pair of tray supporting members 301L and 301R of which a longitudinal direction is the front-rear direction so as to be slidably movable horizontally in the front-rear direction. By the tray supporting members 301L and 301R, the tray 300 is supported so as to be substantially linearly movable between the mounting position Q2 and the pulling-out position Q3 in a direction intersecting (perpendicular to) an axial direction of the drums 1 of the respective cartridges P supported by the tray 300. By guide portions 400L and 400R provided in the main body 100, the tray supporting members 301L and 301R are supported so as to be movable between the image forming position Q1 and the mounting position Q2 in the inside of the main body 100. Note that, in a state in which the tray supporting members 301L and 301R (tray 300) are located at the image forming position Q1, the cartridges P are also located at the image forming position R. Details of this are described later.

As illustrated in FIG. 2, an opening 305 through which the tray 300 is moved between the inside of the main body 100 and the outside thereof is provided in the front side of the image forming apparatus. Further, on the front side of the image forming apparatus, the openable and closable door (openable and closable member) 200 is openably and closably provided for opening and closing the opening 305. The door 200 is provided on the main body 100 so as to be movable between a closing position of closing the opening 305 and an opening position of opening the opening 305.

Hence, that the tray 300 is located at the inside position I (Q1) is a state where the entirety of the tray 300 is located in the inside of the opening 305. Further, that the tray 300 is located at the pulling-out position Q3 (O) is a state where the tray 300 is located on the outside of the opening 305. However, in this case, the entirety of the tray 300 may not be located on the outside of the opening 305. For example, the cartridge. PK on the deepest side may be located in the inside of the opening 305. This is because, even in such a case, it is easier for the user to attach and detach the cartridge PK in comparison with the case where the cartridge PK is located on a deep side of the main body 100. A grip 300*a* is provided on the tray 300. The grip 300*a* is gripped by the user when the user pushes the tray 300 into the main body 100 or pulls out the tray 300 from the main body 100 to the outside of the main body 100.

In this embodiment, the door 200 is rotatable about lateral shafts 201L and 201R (FIGS. 5 and 9) provided on the lower side of the door 200 with respect to the apparatus main body 100. Specifically, the door 200 rotates about the lateral shafts 201L and 201R in a rising direction, and thereby can be closed to the apparatus main body 100 as illustrated in FIG. 1. The opening 305 is closed by closing the door 200. Further, the door 200 rotates about the lateral shafts 201L and 201R to the forward side of the apparatus main body 100, and thereby can be opened from the apparatus main body 100 as illustrated in FIG. 5. In such a way, the opening 305 is opened to a large extent. Note that the user engages the fingers with a finger-receiving recess 200*a* at the time of opening and closing the door 200.

The door 200 and the tray supporting members 301L and 301R are coupled to each other by hinge members 201 provided on the main body 100. Therefore, the tray supporting members 301L and 301R move in association with opening/closing operations of the door 200 (FIG. 5, FIG. 6A). Here, a description will be provided of a relationship between the tray supporting member 301L and the guide portion 400L by illustrating the tray supporting member 301L side. However, a similar construction is also made on the tray supporting member 301R side. As illustrated in FIG. 10 and FIG. 11, bosses 302L and 303L are individually provided on the tray supporting member 301L. The bosses 302L and 303L are engaged with guide portions 401L and 402L provided on the main body side guide portion 400L, and move along shapes of the guide portions 401L and 402L.

The user opens the door 200 to open the opening 305. Then, the tray supporting member 301L is moved along the shapes of the guide portions 401L and 402L by the hinge members 201 by a predetermined amount upward and in the forward direction in association with the opening operation of the door 200. By the movement of the tray supporting member 301L, the tray 300 supported by the tray supporting member 301L moves similarly. Hence, the tray 300 is lifted up from the image forming position Q1 illustrated in FIGS. 6A and 6B to the mounting position Q2 illustrated in FIG. 5. In such a way, the drums 1 of the respective cartridges P are spaced form the belt 13. Then, as illustrated in FIG. 5, the front side of the tray 300 is located at a position of protruding by a predetermined amount from the opening 305 to the outside of the main body 100. This position is the mounting position Q2. At this stage, it becomes easy for the user to pull out the tray 300 to the outside of the main body 100.

Then, as illustrated in FIG. 9, the user pulls out the tray 300 to the pulling-out position Q3. In such a way, the respective cartridges P can be taken out from the tray 300 (FIG. 4). The tray 300 supports the individual cartridges P so that the cartridges P can be taken out directly upward. Further, the tray 300 supports the individual cartridges by moving the cartridges directly downward. Specifically, the used cartridge to be exchanged is lifted upward from the tray 300 and is pulled and detached therefrom after the tray 300 is moved to the pulling-out position Q3. Then, after the new cartridge P is fitted into the tray 300 from the above and is supported thereby, the tray 300 that supports the new cartridge P thereon is moved again from the pulling-out position Q3 to the mounting position Q2.

After that, the door 200 is closed to close the opening 305. In association with the closing operation of the door 200, the tray supporting member 301L is moved by a predetermined amount downward and in the rear direction along the shapes of the guide portions 401L and 402L (FIG. 11). By the movement of the tray supporting members 301L and 301R, the tray 300 supported by the tray supporting member 301L also moves similarly. Specifically, the tray 300 is pushed down from the mounting position Q2 (illustrated in FIG. 5) to the image forming position Q1 (FIG. 6). In such a way, the drums 1 of the respective cartridges P abut on the belt 13, and the respective cartridges P turn to a state of capable of forming the images. Specifically, the respective cartridges P are located at the image forming position R (FIG. 3).

Figure 7B:
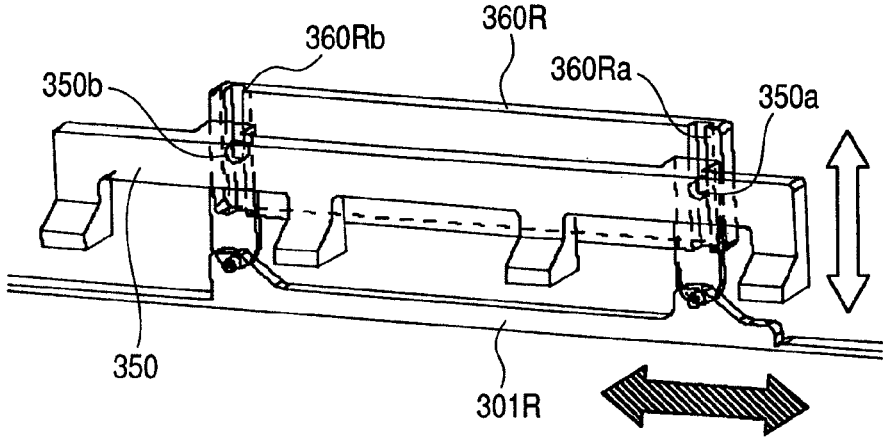
Figure 8:
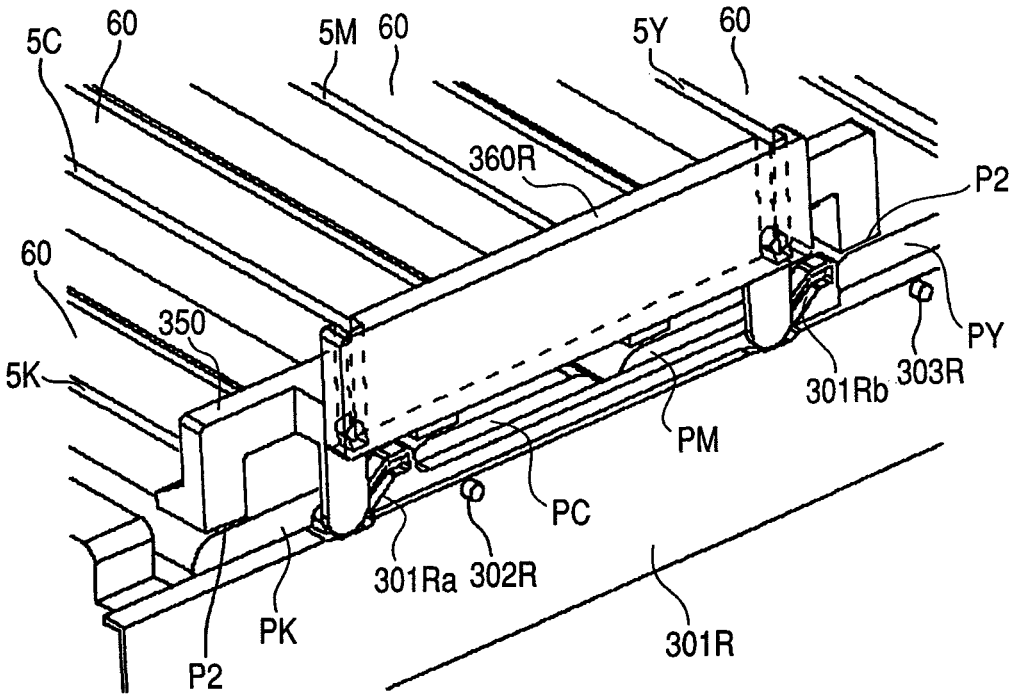
FIG. 8 is an enlarged perspective view of the periphery of the pressing member that presses the cartridges on the image forming apparatus.

In the state in which the tray 300 is located at the mounting position Q2, the respective cartridges P supported by the tray 300 are pressed on and fixed to a main body side supporting member 80L (FIG. 6B) (and 80R on the opposed side), which forms a frame structure of the main body 100, by elastic force of a pressing member 350 (FIGS. 7A and 7B and FIG. 8). Specifically, the cartridges P are positioned to the main body 100, and are located at the image forming position Q1. Here, in FIGS. 7A and 7B and FIG. 8, the pressing member 350 is illustrated only on one side in the longitudinal direction of the cartridges P. However, two pressing members 350 may be provided on both sides thereof. On the tray supporting member 301R, guide portions 301Ra and 301Rb are provided. The pressing member 350 engages with the guide portions 301Ra and 301Rb, and moves along shapes of the guide portions 301Ra and 301Rb. Engagement portions 350*a* and 350*b* provided on the pressing member 350 as illustrated in FIG. 7A are supported by a pressing supporting member 360R provided on the main body 100. Therefore, movement of the pressing member 350 is regulated in a direction of groove portions 360Ra and 360Rb by the pressing supporting member 360R (FIG. 7B). Therefore, the pressing member 350 moves in a vertical direction indicated by the arrow in association with movement of the tray supporting member 301R in a direction (front-rear direction of the product) indicated by the hatched arrow. Hence, the pressing member 350 presses the respective cartridges P in the same direction as the movement direction of the tray 300 in association with such an operation that the tray supporting member 301R that supports the tray 300 moves from the mounting position Q2 to the image forming position Q1. Note that the supporting member 80L (refer to FIG. 6B and FIG. 9) and the supporting member 80R (refer to FIG. 5 and FIG. 6A), which are opposite to each other on left and right sides of the main body 100, are fastened to each other by a stay member (not shown).

Here, a description will be provided of a specific construction of positioning the cartridges P with respect to the main body 100. One end sides and other end sides of the cartridges P in the longitudinal direction (longitudinal direction of the drums 1) are pressed downward by the elastic force of the pressing member 350 (FIGS. 7A and 7B and FIG. 8). Specifically, in the state in which the cartridges P are located in the main body 100, upper surfaces P2 of the cartridges P, which are on the one end sides and the other end sides, are pressed by the pressing member 350. Further, in the state in which the cartridges P are located in the main body 100, circular arc portions P3 (FIG. 4, FIG. 6A, FIG. 6B, FIG. 10, FIG. 11) coaxial with the drums 1 are provided on lower surfaces of the cartridges P, which are on the one end sides and the other end sides. (The circular arc portions P3 on the one end sides are only illustrated in those drawings.) Further, on the supporting member 80L, recessed portions (main body side positioning portions) 80*a* are provided at positions corresponding to the one end sides of the cartridges P. In a similar way, on the support portion 80R, recessed portions (main body side positioning portions, not shown) are provided at positions corresponding to the other end sides of the cartridges P. Hence, in the cartridges P, the upper surfaces P2 on the one end sides and the other end sides in the longitudinal direction are pressed by the pressing member 350. Further, in the cartridges P, the circular arc portions (cartridge side positioned portions) P3 provided on the lower surfaces on the one end sides and the other end sides are pressed on the recessed portions 80*a* provided on the main body 100 (supporting members 80L, 80R). In this state, the cartridges P are positioned to the main body 100, and in other words, are positioned at the image forming position R. Here, the recessed portions (main body side positioning portions) 80*a* are provided on the main body 100 for each of the cartridges P located at the image forming position Q1. In this embodiment, the circular arc portions P3 are provided coaxially with the drums 1. Hence, the cartridges P can be positioned to the main body 100 while taking the drums 1 as centers.

Next, with reference to FIG. 12 and FIG. 13, a description will be provided of an electrical connection between the cartridge side electric contacts 500S of each of the cartridges and the main body side electric contacts 500H provided on the main body 100.

In the case of pressing and fixing each of the cartridges P to the supporting members 80L and 80R by the elastic force of the pressing member 350, the main body side electric contacts 500H provided on the main body 100 and the cartridge side electric contacts 500S of each of the cartridges directly contact each other without interposing the tray 300 therebetween. In such a way, the main body 100 and the cartridge P are electrically connected to each other. Specifically, the pressing member 350 presses the cartridge P in association with a movement operation of the tray 300 from the mounting position (second position) Q2 to the image forming position (first position) Q1. Then, the pressing member 350 presses the circular arc portion (cartridge side positioned portion) P3 on the recessed portion (main body side positioning portion) 80*a*. In such a way, the cartridge P is positioned to the image forming position R.

As illustrated in FIGS. 12A-12C and FIG. 13, the electric contacts 500H are provided on the supporting member 80L side in the vicinity where the circular arc portion P3 contacts with the recessed portion 80*a* in order that the electric contacts 500H are electrically connected to the cartridges P. In this embodiment, as illustrated in FIG. 10 and FIG. 11, main body side electric contact holders (moving members) 500 (500Y, 500M, 500C, 500K) opposed to the respective cartridges P are provided on the supporting member 80L. Further, on tip ends of the holders 500Y, 500M, 500C, and 500K, the main body side electric contacts 500H are provided. Then, in the state in which the cartridges P are positioned to the main body 100 as described above, the main body side electric contacts 500H and the cartridge side electric contacts 500S electrically contact each other. In other words, both of the electric contacts contact each other. As illustrated in FIGS. 12A-12C and FIG. 13, the main body side electric contacts 500H and the cartridge side electric contacts 500S are provided on a non-drive side of each of the cartridges P. The non-drive side is a side on which the drive input portion (not shown) is not provided. Further, the non-drive side is a side, in the longitudinal direction of the cartridge P, opposite to the side on which the cartridge P receives a rotational drive force from the main body 100. The electric contacts 500H and 500S contact each other on the non-drive side, and accordingly, a degree of freedom in arranging the electric contacts 500H and the electric contacts 500S is increased. This is because it is not necessary to consider arrangement of a drive transmission system at the time of deciding the arrangement of the electric contacts 500H and 500S. Hence, the cartridge side electric contacts 500S are arranged on a lower surface 502 (FIG. 13, lower surface of the cartridge frame 60) on the one end side of the cartridge P in the above-mentioned longitudinal direction, on which a drive force receiving member (not shown) is not provided. Note that the lower surface is a surface located downward in the state in which the cartridge P is positioned to the main body 100.

Note that, in this embodiment, the electric contacts 500S include three electric contacts 500S1, 500S2, and 500S3 (FIGS. 12A-12C, FIG. 13) independent of one another. The electric contact (drum grounding electric contact) 500S1 is electrically connected to the drum 1, and grounds the drum by being connected to the electric contact 500H1. The electric contact (developing bias electric contact) 500S2 is electrically connected to the developing roller 3, and receives a bias, which is to be applied to the developing roller 3, by being connected to the electric contact 500H2. The electric contact (charging bias electric contact) 500S3 is electrically connected to the charging roller 2, and receives a bias, which is to be applied to the charging roller 2, by being connected to the electric contact 500H3. Likewise, the electric contacts 500H include the three electric contacts 500H1, 500H2, and 500H3 (FIGS. 12A-12C, FIG. 13) independently of one another. The electric contact (main body side drum grounding electric contact) 500H1 grounds the drum by being connected to the electric contact 500S1. The electric contact (main body side developing bias electric contact) 500H2 applies the developing bias to the electric contact 500S2 by being connected to the electric contact 500S2. The electric contact (main body side charging bias electric contact) 500H3 applies the charging bias to the electric contact 500S3 by being connected to the electric contact 500S3. Note that, in this embodiment, the electric contacts 500S1, 500S2, and 500S3 are arranged in line. In a similar way, the electric contacts 500H1, 500H2, and 500H3 are arranged in line. Hence, the electric contacts can be arranged compactly, and accordingly, each of the holders 500 can be reduced in size. Note that the respective biases are supplied from a power supply (not shown) provided in the main body 100. Hence, though not shown, the electric contacts 500H2 and 500H3 are electrically connected to the power supply. In this embodiment, the electric contacts 500H2 and 500H3 are conductive elastic members (for example, plate springs or coil springs), and are electrically connected to the power supply (not shown). Note that the electric contact 500H1 is grounded to the main body 100.

Hence, when the user closes the door 200 to close the opening 305, the tray 300 moves rearward (to the deep side of the main body 100) and downward together with the supporting members 301L and 301R in association with the closing operation of the door 200. In such a way, the tray 300 moves from the mounting position Q2 to the image forming position Q1. At the same time, the pressing member 350 moves downward to press each of the cartridges P in association with the movement of the supporting member 301R. In such a way, as illustrated in FIG. 13, the electric contacts 500S provided on the lower surface 502 of each of the cartridges P and the electric contacts 500H directly contact each other so as to be electrically connected to each other. At the same time, the main body side drive output portion (not shown) is connected to the drive input portion (not shown) of each of the cartridges. In this case, spring properties are imparted to either the electric contacts 500H or the electric contacts 500S so that a stable connection is enabled. A wire spring type or a plate spring type may impart the spring properties to the electric contacts. In this embodiment, the main body side electric contacts 500H are formed into plate springs. In such a way, the cartridge side electric contacts 500S can be fixed. Hence, the electric contacts 500S can be suppressed from being damaged before the cartridge P is mounted to the main body 100. In the case where each of the holders 500 is fixed to the main body 100 (FIG. 12A), it is sometimes assumed that the electric contacts 500S provided on the lower surface 502 of the cartridge P and the main body side electric contacts 500H rub against each other when the cartridge P moves to the image forming position R. When both of the electric contacts rub against each other extremely, there is a fear that the electrical connection therebetween may become unstable.

In this connection, an interlock construction of the holder 500 including the main body side electric contacts 500H and the tray 300 (cartridge side electric contacts 500S) that supports the cartridges P will be described in order to solve such a fear as described above.

According to this construction, when the electric contacts 500H and the electric contacts 500S are connected to each other, both of the electric contacts can be suppressed from rubbing against each other. Hence, both of the electric contacts can be connected smoothly to each other, and can be connected more surely to each other.

FIGS. 12B and 12C illustrate the construction described above. As illustrated in FIG. 12B, the holder 500 is attached to the main body 100 (supporting member 80L) so as to be rotatable about a rotation center 500*b*. The holder 500 is provided to be inclined town upstream side in a movement direction along which the tray 300 is moved from the pulling-out direction Q3 to the inside position I, by an elastic force of an elastic member (coil spring in this embodiment) 500*c* (FIG. 12B). Note that an inclined position of the holder 500 is regulated by a stopper 500*d*. A protruding portion (engaged portion) 500*a* provided on the holder 500 is engaged with an engagement portion 301Lc provided on the supporting member 301L in the moving process (in the direction indicated by the arrow in FIG. 12B) in which the tray 300 is moved from the pulling-out position Q3 to the inside position I (image forming position Q1). Then, the engagement portion 301Lc pushes the protruding portion (engaged portion) 500*a* (holder 500) against the above-mentioned elastic force in association with the movement of the tray 300. In such a way, the engagement portion 301Lc moves the holder 500. Specifically, the movement of the tray 300 and the movement of the holder 500 are interlocked with each other. Then, in the state in which the tray 300 is located at the image forming position Q1, the electric contacts 500H and the electric contacts 500S are connected to each other (contact each other) (FIG. 12C). In such a way, the electric contacts 500H and the electric contacts 500S can be connected to each other in a stable state without rubbing against each other. As described above, the holder 500 is made to follow the cartridge P (tray 300) by the movement thereof. When the cartridge P is located at the pulling-out position Q3, the holder 500 is urged by the elastic force of the elastic member 500*c* so as to be located at the position illustrated in FIG. 12B. When the cartridge P is moved from the pulling-out position Q3 to the image forming position R (FIG. 12C) (in the direction indicated by the arrow in FIG. 12B), the engagement portion 301Lc of the supporting member 301L pushes the protruding portion 500*a* of the holder 500. In such a way, the holder 500 can be moved in association with the movement of the cartridge P. In such a way, when the cartridge P reaches the image forming position R, both of the electric contacts 500H and 500S are surely connected to each other (FIG. 12C). Hence, the electric contacts 500S provided on the lower surface of each of the cartridges P and the main body side electric contacts 500H do not rub against each other, and the stable connection therebetween is enabled. Note that, in this embodiment, the holder 500 is moved along the movement direction of the tray 300 to connect both of the electric contacts to each other. Specifically, the holder (moving member) 500 is moved along the movement direction of the tray 300 in association with the movement of the tray 300 from the mounting position Q2 to the image forming position Q1. In such a way, according to this embodiment, the holder 500 can be moved by the effective use of a moving force of the tray 300.

As described above, the main body side electric contacts 500H are provided on the holder (moving member) 500. Then, the holder (moving member) 500 is moved in association with a moving operation of the tray 300 from the mounting position (second position) Q2 to the image forming position (first position) Q1. Further, the main body side electric contacts 500H are electrically connected to the cartridge side electric contacts 500S by the movement of the tray 300 from the mounting position (second position) Q2 to the image forming position (first position) Q1. In such a way, when both of the electric contacts 500S and 500H are connected to each other, both of the electric contacts 500S and 500H can be suppressed from rubbing against each other.

Meanwhile, when the door 200 is opened to open the opening 305, the tray 300 that supports the cartridges P is moved in the forward direction (forward side of the main body 100) and upward together with the tray supporting members 301L and 301R in association with the opening operation of the door 200. Specifically, the tray 300 moves from the image forming position Q1 to the mounting position Q2. At the same time, the pressing member 350 is moved upward in association with the movement of the tray supporting member 301R so as to release the pressure against the respective cartridges P. Specifically, the tray supporting member 301R is moved in association with the operation that the door 200 opens the opening 305, whereby the pressing member 350 is moved upward along the shapes of the guide portions 301Ra and 301Rb (FIG. 7). In such a way, the pressing of the pressing member 350 exerted on the respective cartridges P is released. In such a way, the respective cartridges P are moved upward. Then, the electric contacts 500S provided on the lower surface 502 of each of the cartridges P and the main body side electric contacts 500H are spaced from each other (FIGS. 12A and 12B) so that the electrical connection therebetween is released. At the same time, the connection of the main body side drive output portions (not shown) to the drive input portions (not shown) of the respective cartridges P is released into a drive force disconnected state.

According to the above-mentioned embodiment, the number of components can be reduced in comparison with the construction of electrically connecting the main body 100 and the cartridges P to each other while interposing the tray 300 therebetween. Further, the construction of electrically connecting the main body 100 and the cartridges P to each other can be simplified.

Further, according to the above-mentioned embodiment, the main body 100 and the cartridges P can be electrically connected to each other in association with the operation of closing the door 200, and the electrical connection therebetween can be released in association with the operation of opening the door 200. In such a way, operability when the user exchanges the cartridges P can be enhanced.

Second Embodiment

Figure 14A:
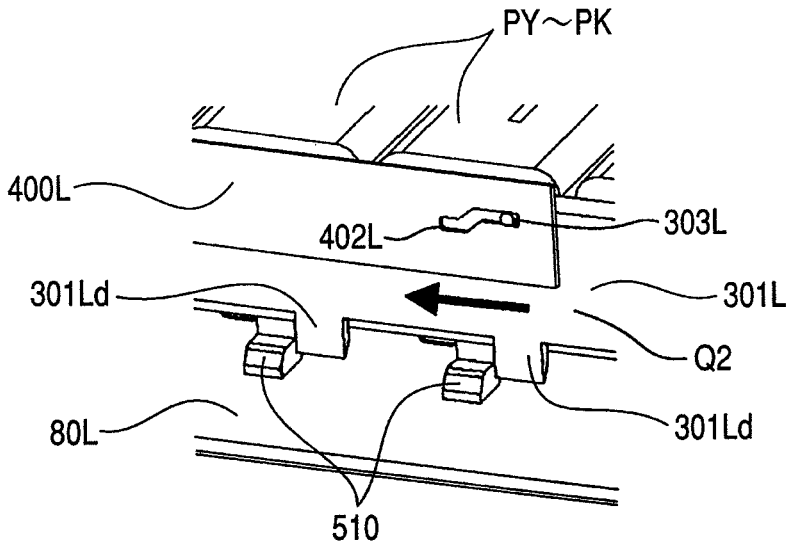
FIG. 14A is an enlarged perspective view.
Figure 14B:
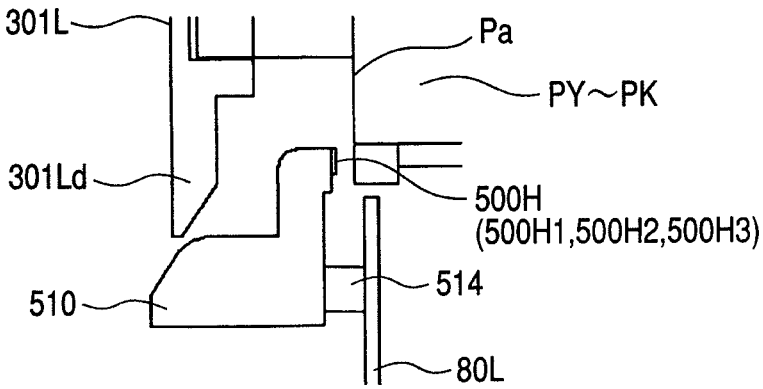
FIG. 14B is an enlarged cross-sectional view, illustrating a state in which supply of power to cartridges is released in an image forming apparatus according to a second embodiment of the present invention.
Figure 15A:
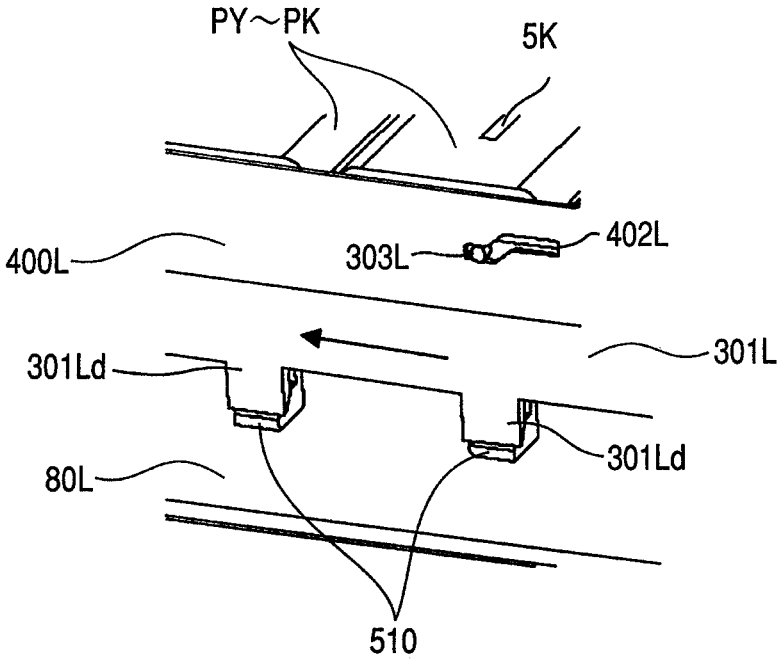
FIG. 15A is an enlarged perspective view.
Figure 15B:
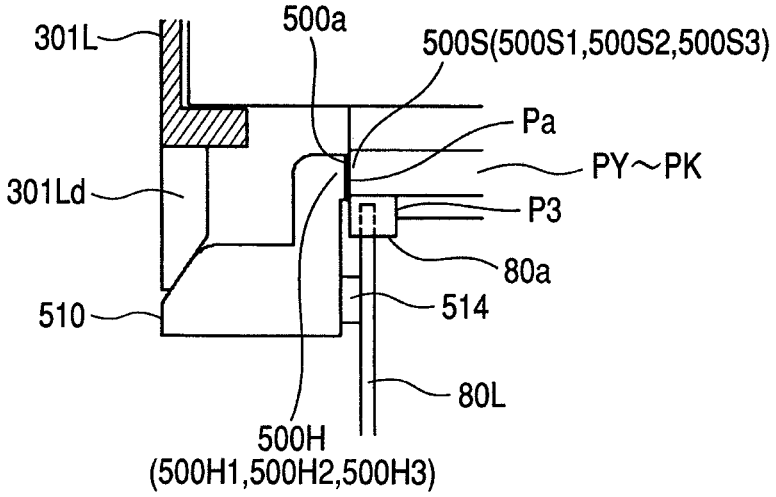
FIG. 15B is an enlarged cross-sectional view, illustrating a state in which the power can be supplied to the cartridges in the image forming apparatus according to the second embodiment.
Figure 16A:
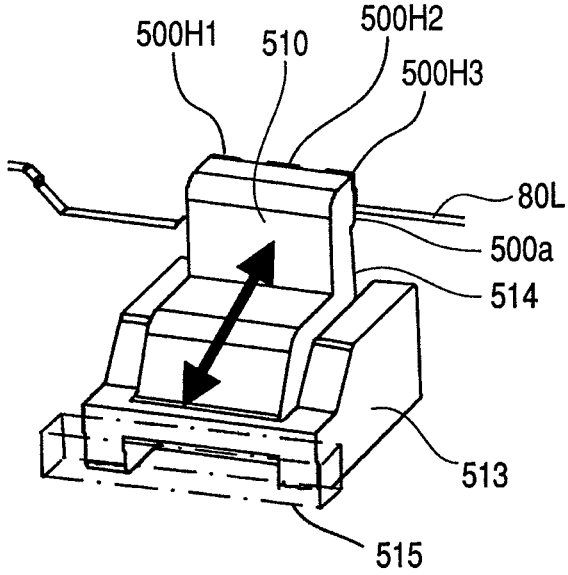
FIG. 16A is an enlarged perspective view.
Figure 16B:
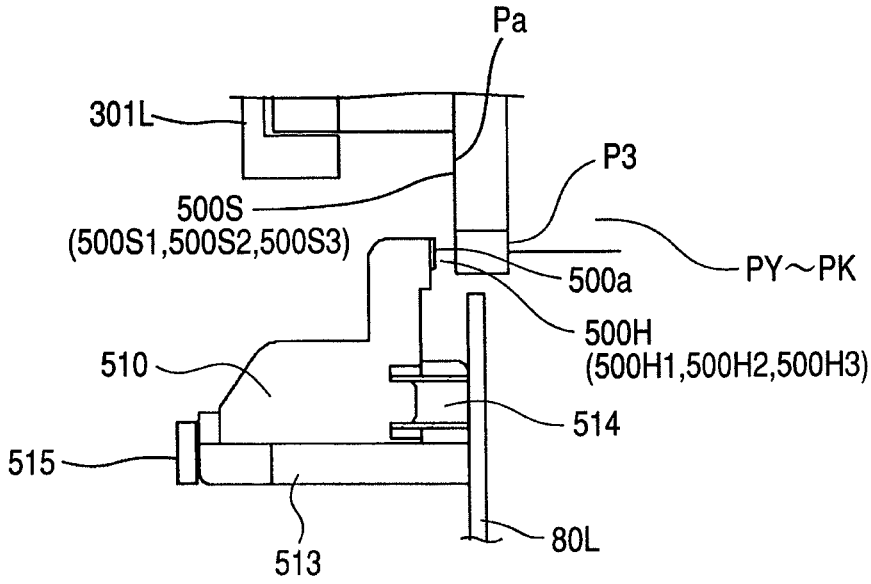
FIG. 16B is an enlarged cross-sectional view, illustrating a construction of a power supply portion according to the second embodiment.
Figure 17A:
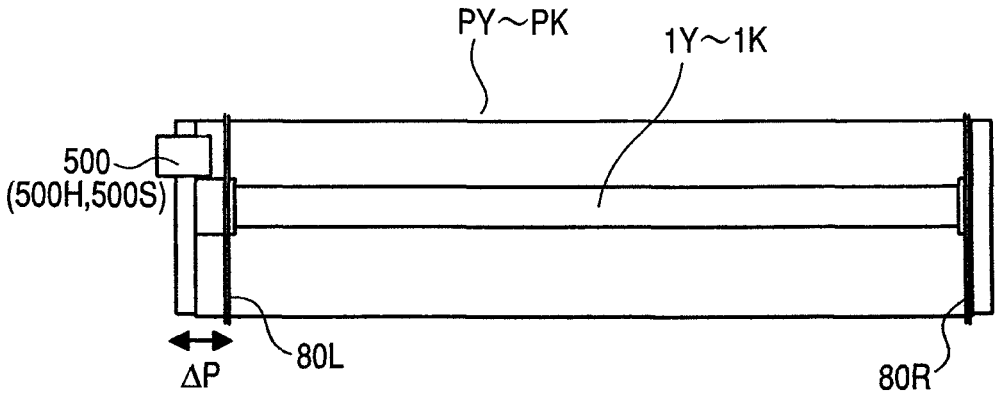
FIGS. 17A and 17B are longitudinal schematic views of the power supply portion and the cartridges in the first embodiment and the second embodiment.
Figure 17B:
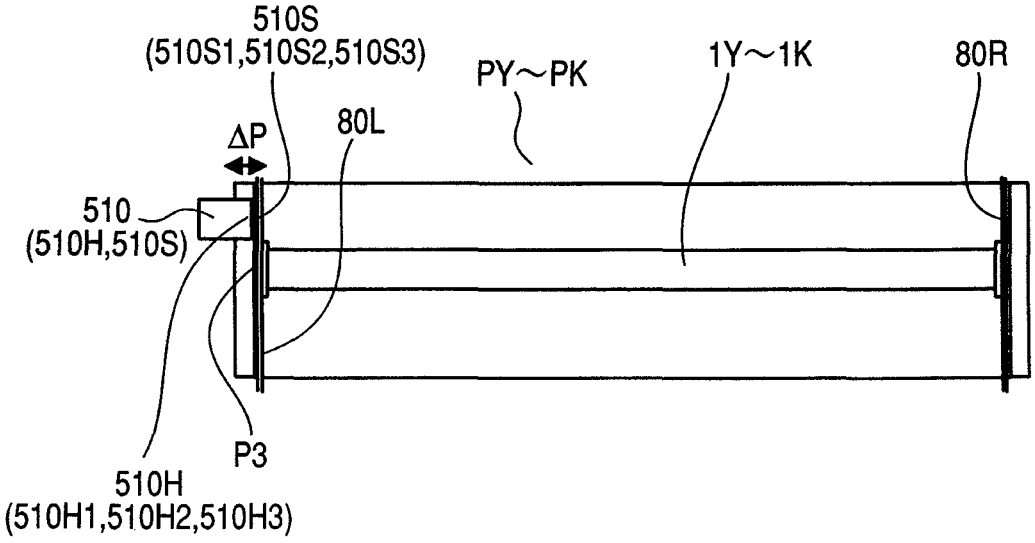

An electrophotographic image forming apparatus according to a second embodiment of the present invention will be described with reference to FIGS. 14A and 14B to FIGS. 17A and 17B. FIGS. 14A and 14B illustrate the image forming apparatus according to the second embodiment. Specifically, FIG. 14A is an enlarged perspective view illustrating a state where supply of power to cartridges is released, and FIG. 14B is an enlarged cross-sectional view illustrating the same state. FIGS. 15A and 15B illustrate the image forming apparatus according to the second embodiment. Specifically, FIG. 15A is an enlarged perspective view illustrating a state where the power can be supplied to the cartridges, and FIG. 15B is an enlarged cross-sectional view illustrating the same state. FIGS. 16A and 16B are construction views of a power supply portion according to the second embodiment. FIGS. 17A and 17B are longitudinal schematic views of the power supply portion and the cartridges in the first embodiment and the second embodiment of the present invention.

Note that a construction of the entire image forming apparatus according to this embodiment is similar to that in the above-mentioned embodiment. Therefore, the same reference symbols denote those having similar functions, and a description thereof is omitted. Here, a description will be provided only of an electrical connection between the main body and the cartridges, which is different from that of the first embodiment.

In a similar way to the first embodiment, this embodiment has such a construction in which the lower sides of the respective cartridges P are electrically connected to the main body. Further, in a similar way to the first embodiment, this embodiment has such a construction in which the holders 500 including the main body side electric contacts 500H and the tray 300 (cartridge side electric contacts 500S) that supports the cartridges P are interlocked with each other. Note that, in this embodiment, holders (moving members) 510 are moved in a direction perpendicular to the movement direction of the tray 300 to connect both of the electric contacts to each other.

In the first embodiment, the electric contacts 500S (500S1, 500S2, 500S3) are provided on the lower surface 502 of each of the cartridges P, and are to be connected to the main body side electric contacts 500H (500H1, 500H2, 500H3). Accordingly, in the state in which the cartridge P is mounted to the main body 100, it is necessary that the cartridge side electric contacts 500S be arranged outside of the supporting member 80L in the longitudinal direction of the cartridge. Accordingly, in order to arrange the cartridge side electric contacts 500S at the above-mentioned positions, it is necessary to increase a length (size) of the cartridge in the longitudinal direction (FIG. 17A). Such an increased size is indicated by ΔP (FIG. 17A).

The construction of making such an electrical connection as described above on the lower end surface of each of the cartridges is described with reference to FIGS. 14A and 14B to FIGS. 16A and 16B. FIG. 14A is a perspective view illustrating a state where the tray 300 is located at the mounting position Q2, and FIG. 14B is a side view illustrating the same state. FIG. 15A is a perspective view illustrating a state where the tray 300 is located at the image forming position, and FIG. 15B is a side view sowing the same state. In the state in which the tray 300 is located at the mounting position Q2, the holders (moving members) 510 provided on the main body 100 (supporting member 80L) are spaced from the end surfaces of the cartridges P (FIG. 14B). Hence, when the user pulls out the tray 300 to the front side (forward side) of the apparatus, the holders 510 do not hinder such a pulling-out operation. After that, the user pushes the tray 300 into the main body 100, and closes the door 200. The tray 300 is moved from the mounting position Q2 to the image forming position Q1 in association with the closing operation of the door 200. At this time, the tray supporting member 301L is moved in a direction indicated by the arrow in FIG. 14A. Accordingly, pushing-out portions (engagement portions) 301Ld, which are provided on the tray supporting member 301L and protruded downward, overlap positions where the holders 510 are provided. Finally, the tray supporting member 301L is moved down in accordance with a shape of the guide member 400L. Specifically, the tray supporting member 301L is moved down and toward the deep side of the main body 100. In association with this operation, the pushing-out portions (engagement portions) 301Ld provided on the tray supporting member 301L push out the holders (moving members) 510 to the cartridge side (FIG. 15B). In such a way, the electric contacts 500S (500S1, 500S2, 500S3) provided on an end surface Pa of each of the cartridges P in the longitudinal direction and the main body side electric contacts 500H (500H1, 500H2, 500H3) are electrically connected to each other. Note that each of the holders 510 is supported by a slide holder 513 so as to be movable in a direction indicated by the arrow, and is urged in a direction of being spaced from the cartridge P by an elastic force of an elastic member (spacing spring) 514 (FIGS. 16A and 16B). Hence, at the time of pushing out the holder 510 to the cartridge side, each of the pushing-out portions (engagement portions) 301Ld pushes out the holder 510 against the above-mentioned elastic force. Note that each of stoppers 515 regulates a position where the holder 510 is spaced from the cartridge P by the elastic force of the elastic member 514. Such a position where the movement of the holder 510 is regulated by the stopper 515 is a standby position (FIG. 16B). At the standby position, the holder 510 does not inhibit the movement of the tray 300 caused by the pulling-out and pushing-in operations of the tray 300.

Note that, in this embodiment, cartridge side electric contacts 510S (510S1, 510S2, 510S3) correspond to the cartridge side electric contacts 500S (500S1, 500S2, 500S3) of the above-mentioned embodiment, respectively. However, in this embodiment, the electric contacts 510S are provided on the end surface (side surface) Pa of the cartridge P. Further, main body side electric contacts 510H (510H1, 510H2, 510H3) correspond to the main body side electric contacts 500H (500H1, 500H2, 500H3) of the above-mentioned embodiment, respectively. However, in this embodiment, the electric contacts 510H are arranged on an end surface (side surface) 510*a* of each of the holders 510. Then, the holder 510 is moved in the direction perpendicular (including intersect) to the movement direction of the tray 300 with the end surface 510*a* being the leading edge, whereby both of the electric contacts 510S and 510H are connected to each other. Hence, according to this embodiment, when the cartridges P reach the image forming position R, both of the electric contacts 510H and 510S are surely connected to each other (FIG. 15B). Hence, the electric contacts 510S provided on the end surface Pa of each of the cartridges P and the electric contacts 500H provided on the end surface 510*a* of each of the holders 510 do not rub against each other, and a stable connection therebetween is enabled. Further, the number of components can be reduced in comparison with the construction of electrically connecting the main body 100 and the cartridges P to each other while interposing the tray 300 therebetween. Further, the construction of electrically connecting the main body 100 and the cartridges P to each other can be simplified.

Further, in addition to the above, according to this embodiment, the length (size) of the cartridge P in the longitudinal direction can be reduced in comparison with the above-mentioned embodiment because of the following reasons.

According to the above-mentioned embodiment, the cartridge side electric contacts 510S are arranged on the end surface (side surface) Pa of one end of each of the cartridges P in the longitudinal direction. Further, the cartridge side electric contacts 510S are arranged on the cartridge P so as to be located below the tray supporting member 301L in the state in which the cartridge P is located at the image forming position R. In addition, the cartridge side electric contacts 510S can be arranged at the same positions as the position where the circular arc portion (cartridge side positioned portion) P3 is provided in the longitudinal direction of the cartridge P or at positions inside the position of the circular arc in the state in which the cartridge P is located at the image forming position R. Specifically, the cartridge side electric contacts 510S are arranged on the end surface Pa in the longitudinal direction of the cartridge P. In addition, the electric contacts 510S are arranged so as to be located below the tray 300 in the state in which the cartridge P is supported by the tray 300. In addition, the electric contacts 510S are arranged at the same positions as the position of the circular arc portion (cartridge side positioned portion) P3 positioned to the recessed portion (main body side positioning portion) 80*a* or at positions inside the position of the circular arc portion P3 in the longitudinal direction of the cartridge P in the state in which the cartridge P is located at the image forming position R. In such a way, it is not necessary that the length of the cartridge P in the longitudinal direction be set equal to or more than that of an engaged region of the circular arc portion (cartridge side positioned portion) P3 and the recessed portion (main body side positioning portion) 80*a*. Accordingly, each of the cartridges P is downsized, whereby the entire apparatus can be downsized. The length ΔP indicated in FIG. 17B is shorter than the length ΔP indicated in FIG. 17A. According to this embodiment, the length of the cartridge P can be shortened by the amount that the length ΔP is shorter. Specifically, because the electric contacts 510S are arranged at the above-mentioned positions, such a distance ΔP between the supporting member 80L and the cartridge end surface Pa can be minimized (FIG. 17B). Accordingly, the entire apparatus can be downsized.

As described above, the main body side electric contacts 510H are provided on the holder (moving member) 510. Then, the holder (moving member) 510 is moved in association with the moving operation that the tray 300 is moved from the mounting position (second position) Q2 to the image forming position (first position) Q1. Further, the main body side electric contacts 510H are electrically connected to the cartridge side electric contacts 510S by the tray 300 being moved from the mounting position (second position) Q2 to the image forming position (first position) Q1. In such a way, when both of the electric contacts 510S and 510H are connected to each other, both of the electric contacts 510S and 510H can be suppressed from rubbing against each other. Further, the holder 510 is moved in the direction intersecting the movement direction of the tray 300 in association with the moving operation that the tray 300 is moved from the mounting position Q2 to the image forming position Q1. In such a way, according to this embodiment, the holder 510 (main body side electric contacts 510H) can be moved by an effective use of the moving force of the tray 300. Further, even if the cartridges P are arrayed densely in the movement direction of the tray 300, the respective holders 510 can be moved.

Third Embodiment

Figure 18A:
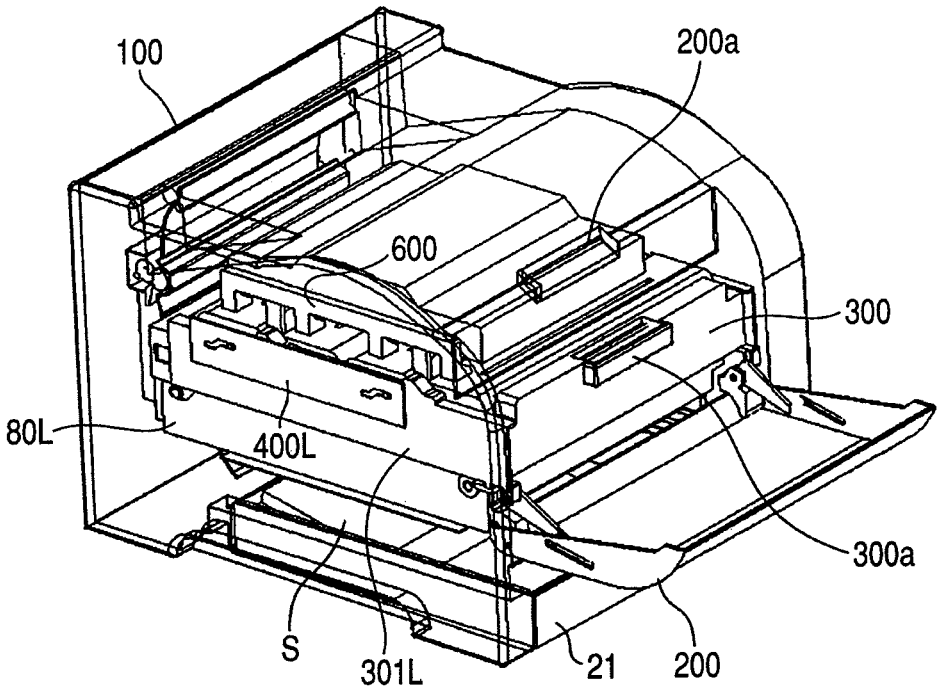
FIG. 18A is a perspective view.
Figure 18B:
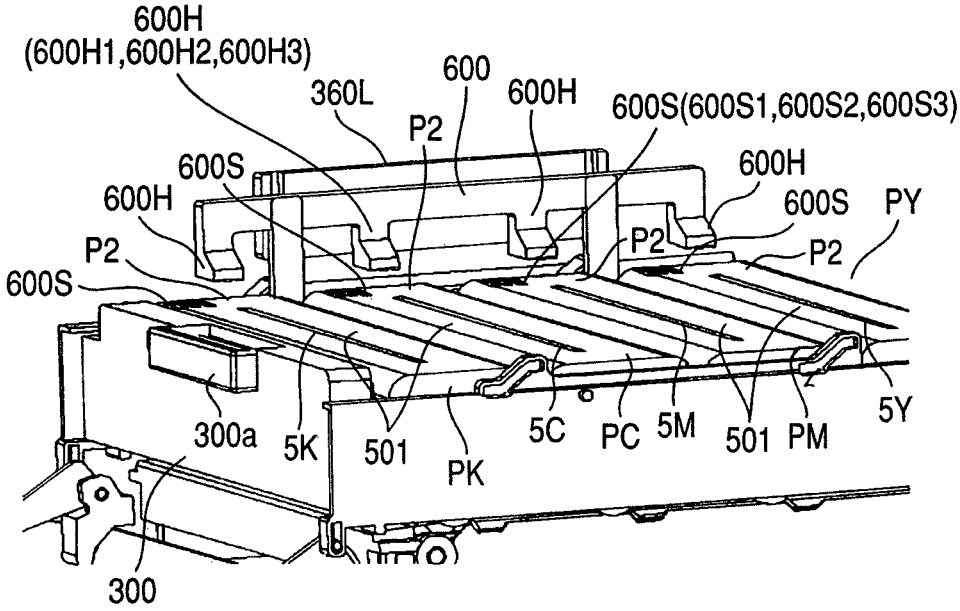
FIG. 18B is a perspective view of a substantial part, illustrating a state in which supply of power to cartridges is released in an image forming apparatus according to a third embodiment of the present invention.
Figure 19A:
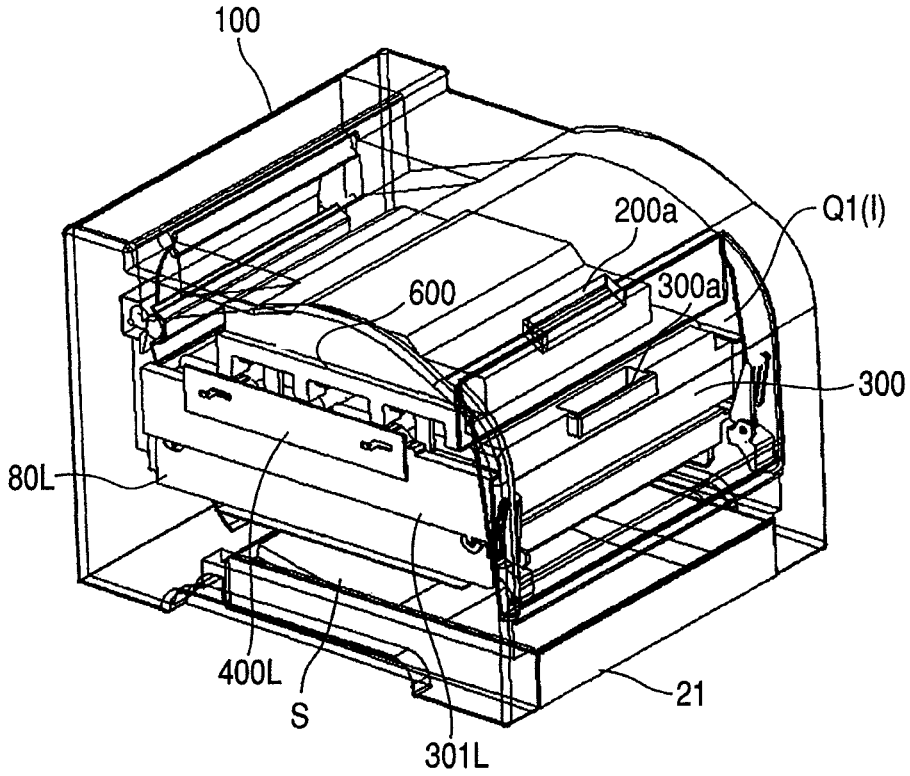
FIG. 19A is a perspective view.
Figure 19B:
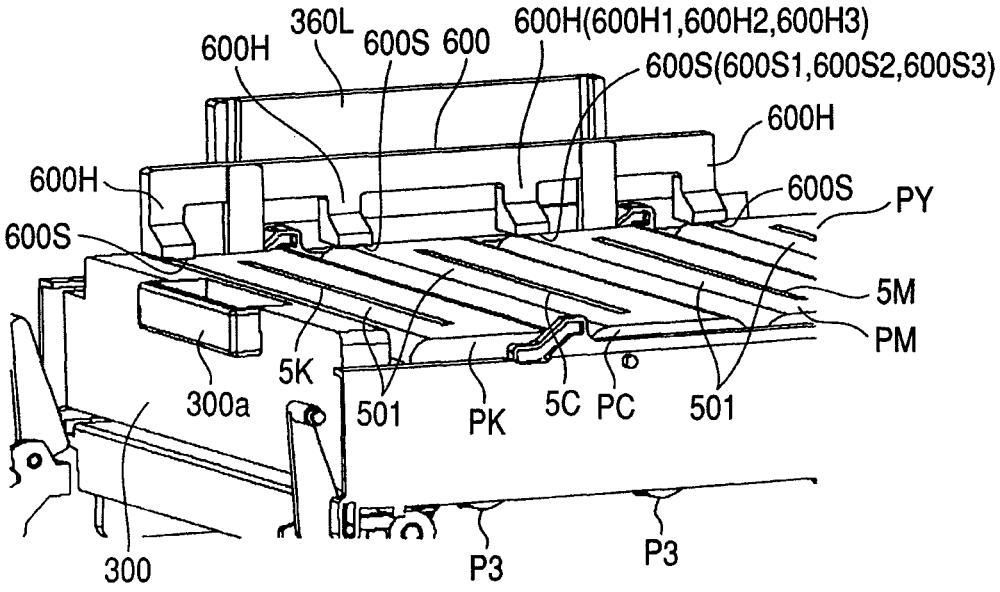
FIG. 19B is a perspective view of a substantial part, illustrating a state in which the power can be fed to the cartridges in the image forming apparatus according to the third embodiment of the present invention.
Figure 20A:
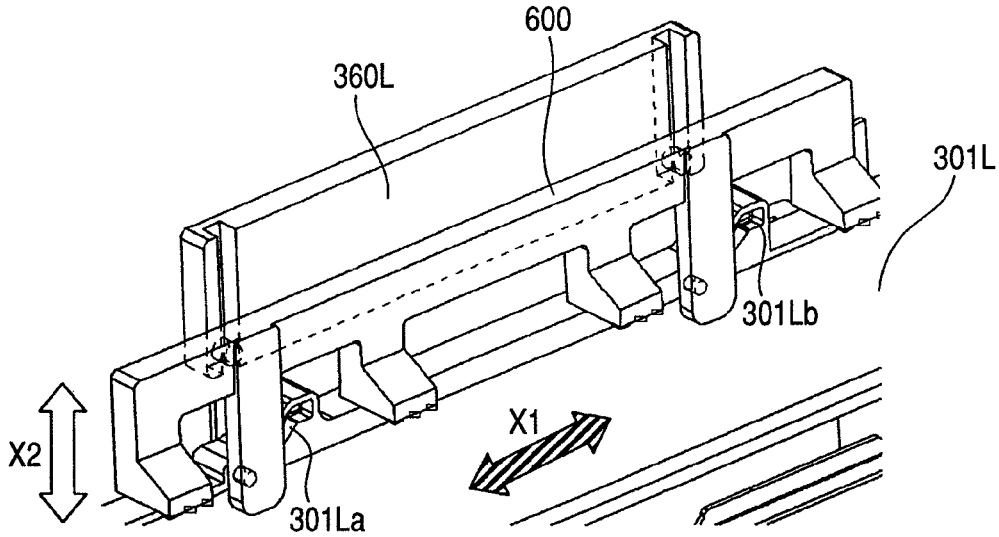
FIGS. 20A and 20B are perspective views of a substantial part of a guide portion and a pressing member guided by the guide portion of the image forming apparatus according to the third embodiment.
Figure 20B:
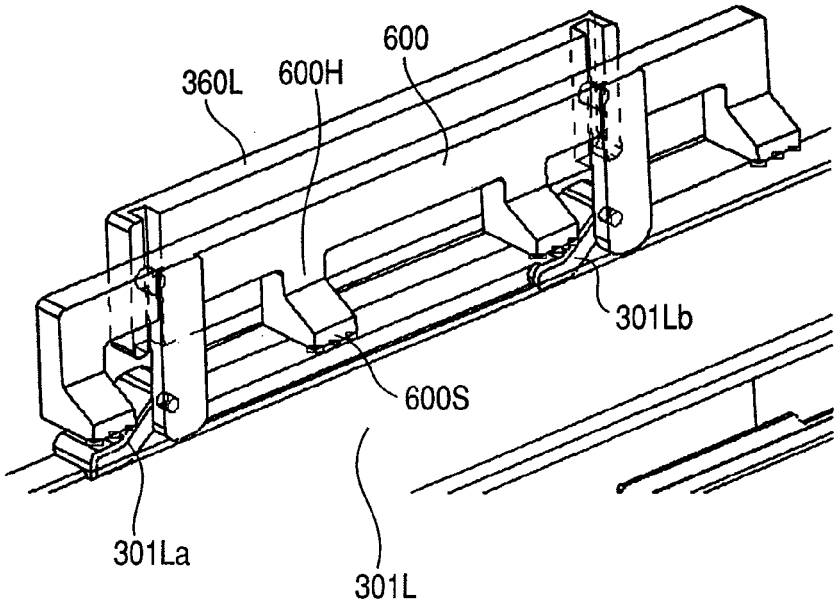

An electrophotographic image forming apparatus according to a third embodiment of the present invention will be described with reference to FIGS. 18A and 18B to FIGS. 20A and 20B. FIGS. 18A and 18B illustrates the image forming apparatus according to the third embodiment. Specifically, FIG. 18A is a perspective view illustrating a state where supply of power to cartridges is released, and FIG. 18B is a perspective view illustrating a substantial part in the same state. FIG. 19A is a perspective view illustrating a state where the power can be supplied to the cartridges, and FIG. 19B is a perspective view illustrating the substantial part in the same state. FIGS. 20A and 20B are perspective views of a substantial part of a guide portion provided in the image forming apparatus, and of a pressing member guided by the guide portion.

Note that a schematic construction of the entire image forming apparatus according to this embodiment is similar to that in the above-mentioned embodiments. Therefore, the same reference symbols denote those having similar functions, and a description thereof is omitted. Here, a description will be provided only of an electrical connection between the main body and the cartridges, which is different from that of the first embodiment.

In this embodiment, as illustrated in FIGS. 18A and 18B to FIGS. 20A and 20B, the respective cartridges P supported on the tray 300 at the mounting position Q2 are fixed to the supporting members 80L and 80R in a pressed state by a pressing member 600. Here, the pressing member 600 is provided on the non-drive sides of the cartridges P as the other sides thereof in the longitudinal direction. However, the pressing member 600 for the cartridges P may be provided only on the drive sides, only on the non-drive sides, or on both thereof. The pressing member 600 is similar in operation to the pressing member 350 illustrated in the first embodiment. Specifically, the pressing member 600 is moved in the vertical direction indicated by the arrow X2 (FIG. 20A) through a pressing supporting member 360L illustrated in FIGS. 20A and 20B in association with the movement of the tray supporting member 301L in the direction indicated by the arrow X1 (FIG. 20A, front-rear direction of the main body). Hence, in association with an operation that the tray supporting member 301L that supports the tray 300 is moved from the mounting position Q2 (FIG. 18A) to the image forming position Q1 (FIG. 19A), the pressing member 600 presses the respective cartridges P in the same direction as the movement direction of the tray 300. Note that the supporting members 80L and 80R, which form the frame structure of the main body 100, have a similar construction to those of the above-mentioned embodiments. Further, the pressing member 600 has a similar construction to that of the above-mentioned pressing member 350. Further, a construction of positioning the cartridges P to the image forming position R is similar to the above-mentioned constructions.

When the respective cartridges P are pressed on and fixed to the supporting members 80L and 80R by the pressing member 600, as illustrated in FIG. 19B and FIG. 20A, main body side electric contacts 600H provided on the main body 100 and cartridge side electric contacts 600S of the respective cartridges directly contact with each other without interposing the tray 300 therebetween. In such a way, the main body and the respective cartridges P are electrically connected to each other. Note that the main body side electric contacts 600H (600H1, 600H2, 600H3) correspond to the above-mentioned electric contacts 500H (500H1, 500H2, 500H3) and 510H (510H1, 510H2, 510H3). The cartridge side electric contacts 600S (600S1, 600S2, 600S3) correspond to the above-mentioned electric contacts 500S (500S1, 500S2, 500S3) and 510S (510S1, 510S2, 510S3).

As illustrated in FIG. 18B and FIG. 19B, the main body side electric contacts 600H are provided on a contact surface (hereinafter, referred to as lower surface) of the pressing member 600 with the respective cartridges P. Here, the pressing member 600 is provided on the supporting member 80L side as the non-drive side. The main body side electric contacts 600H are provided on the lower surface of the pressing member 600, which is opposed to the respective cartridges P. Further, as illustrated FIG. 18B, the cartridge side electric contacts 600S of the respective cartridges P are provided on end surfaces (hereinafter, referred to as upper surfaces) 501 of the respective cartridges P, with which the pressing member 600 is brought into contact. Specifically, the cartridge side electric contacts 600S are arranged on the upper surfaces 501, which is the upper side in a state in which the cartridges P are supported by the tray 300 (in a state in which the cartridges P are located at the image forming position R).

Hence, when the user closes the door (openable and closable member) 200 and closes the opening 305, then, in association with this closing operation, the tray 300 is moved downward and in the rear direction (deep side of the main body 100) together with the tray supporting members 301L and 301R so as to be moved from the mounting position Q2 to the image forming position Q1. At the same time, the pressing member 600 is moved downward in association with the movement of the tray supporting member 301L to press the upper surfaces of the respective cartridges P. As illustrated in FIGS. 20A and 20B, guide portions 301La and 301Lb are provided on the tray supporting member 301L. Then, the pressing member 600 engages with the guide portions 301La and 301Lb so as to be moved along the shapes of the guide portions 301La and 301Lb. Further, the pressing member 600 is regulated so as to move in the vertical direction by the pressing supporting member 360L. Hence, the tray supporting member 301L is moved in association with such an operation that the door 200 closes the opening 305. In such a way, as illustrated in FIG. 20A, the pressing member 600 is pushed down along the shapes of the guide portions 301La and 301Lb. In such a way, the pressing member 600 presses the upper surfaces 501 of the respective cartridges P. In such a way, as illustrated in FIG. 19B, the electric contacts 600S provided on the upper surfaces 501 of the respective cartridges P and the main body side electric contacts 600H provided on the lower surface of the pressing member 600 directly contact with each other so as to be electrically connected to each other. At the same time, the main body side drive output portions (not shown) are connected to the drive input portions (not shown) of the respective cartridges P. Here, the drive input portions of the cartridges are provided on end portions of the cartridges on a side opposite to a side on which the electric contacts 600S are provided, in the longitudinal direction of the cartridges. However, this embodiment is not limited to this construction. As described above, the cartridge side electric contacts 600S are located on the upper surfaces 501 in the state in which the cartridges Pare supported by the tray 300. Then, the main body side electric contacts 600H are provided on the pressing member 600. The electric contacts 600S and the electric contacts 600H are electrically connected to each other in the state in which the pressing member 600 presses the upper surfaces 501. In such a way, a pressing force (elastic force) of the pressing member 600 can be effectively used for connecting both of the electric contacts 600S and 600H to each other.

Meanwhile, when the user opens the door 200 to open the opening 305, the tray 300 is moved upward and in the forward direction (forward side of the main body 100) together with the tray supporting members 301L and 301R in association with the opening operation, so that the tray 300 is moved from the image forming position Q1 to the mounting position Q2. At the same time, in association with the movement of the tray supporting member 301L, the pressing member 600 is moved upward to release the pressing thereof against the respective cartridges P. Specifically, the tray supporting member 301L is moved in association with the operation that the door 200 opens the opening 305, whereby the pressing member 600 is moved upward along the shapes of the guide portions 301La and 301Lb as illustrated in FIG. 20B. Then, the pressing member 600 releases the pressing thereof against the respective cartridges P. In such a way, as illustrated in FIG. 18B, the electric contacts 600S provided on the upper surfaces 501 of the respective cartridges P and the main body side electric contacts 600H provided on the lower surface of the pressing member 600 are spaced from each other so that the electrical connection therebetween is released. At the same time, the connection of the main body side drive output portions (not shown) to the drive input portions (not shown) of the respective cartridges is released so that the drive transmission is disconnected.

According to the above-mentioned construction, the number of components can be reduced in comparison with the construction of electrically connecting the main body and the cartridges to each other while interposing the cartridge tray therebetween. Further, the construction of electrically connecting the main body and the cartridges to each other can be simplified. Further, the pressing of the cartridges in the positioning direction of the cartridges and the pressing of both of the electric contacts for the connection therebetween are the same in terms of the direction, and accordingly, the positions of the cartridges with respect to the main body become more stable.

Further, according to the above-mentioned respective embodiments, the main body and the cartridges can be electrically connected to each other in association with the closing operation of the door (openable and closable member), and the electrical connection therebetween can be released in association with the opening operation of the door. In such a way, the operability when the user exchanges the cartridges can be enhanced.

Further, according to the above-mentioned respective embodiments, each of the cartridges P has the cartridge side electric contacts 500S (510S, 600S) and the circular arc portion (cartridge side positioned portion) P3.

Further, according to the above-mentioned respective embodiments, the tray 300 is moved from the mounting position (second position) Q2 to the image forming position (first position) Q1, whereby the main body side electric contacts 500H (510H, 600H) are electrically connected to the cartridge side electric contacts 500S (510S, 600S). Note that the main body side electric contacts 500H (510H, 600H) are provided for each of the cartridges P.

Further, according to the above-mentioned respective embodiments, in the state in which the circular arc portions (cartridge side positioned portions) P3 are pressed on the recessed portions (main body side positioning portions) 80*a* by the pressing force (elastic force) of the pressing member 350 (600), the cartridge side electric contacts 500S (510S, 600S) are directly connected electrically to the main body side electric contacts 500H (510H, 600H). In such a way, the main body 100 and the cartridges P are surely connected electrically to each other.

Further, according to the above-mentioned respective embodiments, the main body side electric contacts 500H (510H, 600H) is moved in association with the movement of the tray 300 from the mounting position (second position Q2) to the image forming position (first position) Q1. In such a way, the main body side electric contacts 500H (510H, 600H) are arranged for each of the cartridges P so as to be electrically connected to the cartridge side electric contacts 500S (510S, 600S) of the cartridges P located at the image forming position R. In such a way, according to this embodiment, the main body side electric contacts 500H (510H, 600H) and the cartridge side electric contacts 500S (510S, 600S) are directly connected electrically to each other. Hence, it is not necessary to arrange intermediate electric contacts on the tray 300.

Further, according to the respective embodiments illustrated in FIGS. 12B and 12C to FIGS. 17A and 17B, the main body side electric contacts 500H (510H) are provided on the holders (moving members) 500 (510). Then, the holders (moving members) 500 (510) is moved in association with the movement of the tray 300 from the mounting position (second position) Q2 to the image forming position (first position) Q1. Then, the main body side electric contacts 500H (510H) are electrically connected to the cartridge side electric contacts 500S (510S) by the movement of the tray 300 from the mounting position (second position) Q2 to the image forming position (first position) Q1. Note that the Figures only illustrate the substantial part, and the holders (moving members) 500 (510) are provided for each of the cartridges P. According to this embodiment, the electric contacts 500S (510S) and the electric contacts 500H (510H) can be suppressed from rubbing against each other at the time of contacting with each other. Further, by the moving operation of the tray 300, the respective electric contacts 500S (510S) and the respective electric contacts 500H (510H) can be connected smoothly to each other for each of the cartridges P.

Further, according to the above-mentioned embodiments, the main body 100 is provided with the opening 305 through which the tray 300 is moved to the outside position O of the main body 100, and the door (openable and closable member) 200 openably and closably provided on the main body 100 for opening and closing the opening 305. Then, in association with an operation that the door 200 closes the opening 305, the tray 300 is moved from the mounting position Q2 to the image forming position Q1, and the pressing member 350 (600) presses the cartridges P. Then, in the state in which the pressing member 350 (600) presses the cartridges P, the cartridge side electric contacts 500S (510S, 600S) and the main body side electric contacts 500H (510H, 600H) directly contact with each other. Specifically, the connection between both of the electric contacts can be made smoothly. Further, in association with the operation that the door 200 opens the opening 305, the tray 300 is moved from the image forming position Q1 to the mounting position Q2, and the pressing member 350 (600) releases the pressing thereof against the cartridges P. In such a way, the electric contacts 500S (510S, 600S) and the electric contacts 500H (510H, 600H) are spaced from each other. In such a way, the connection between both of the electric contacts can be released smoothly. Hence, in the case of this embodiment, both of the electric contacts can be electrically connected to each other in association with the opening operation of the door 200, and the connection between both of the electric contacts can be released in association with the closing operation of the door 200. Hence, the connecting operation for both of the electric contacts and the releasing operation for disconnecting the electric contacts can be synchronized with the opening/closing operations of the door 200, and accordingly, the operability can be enhanced.

Further, in the above-mentioned respective embodiments, the tray 300 is moved in the horizontal direction with respect to an installation surface (not shown) of the main body 100. However, this embodiment is not limited to this, and the tray 300 may linearly move, for example, obliquely upward or obliquely downward with respect to the installation surface (not shown) of the main body 100. In this embodiment, the tray 300 is linearly moved in the direction perpendicular to the longitudinal direction of the cartridges P supported (mounted) on the tray 300. Note that the longitudinal direction of the cartridges P is the longitudinal direction of the photosensitive drums 1 or the longitudinal direction of the developing rollers 3 as the developing means. However, the tray 300 may be linearly moved, for example, in a direction along the longitudinal direction of the cartridges P supported (mounted) on the tray 300.

Further, in the above-mentioned respective embodiments, the tray 300 is moved down in a direction vertical with respect to the installation surface (not shown) of the main body 100, and moves from the mounting position (second position) Q2 to the image forming position (first position) Q1. However, this embodiment is not limited to this. For example, the tray 300 may be moved up in the direction vertical with respect to the installation surface (not shown) of the main body 100, and may be moved from the mounting position (second position) Q2 to the image forming position (first position) Q1. In this case, the intermediate transfer belt unit 12 is located above the mounting positions of the cartridges P. Note that, in the case of this construction, the cartridges P are moved up so that the drums 1 contact with the belt 13. The cartridges P are moved down so that the drums 1 are spaced from the belt 13. The present invention is applicable even to the case of such a construction.

Other Embodiments

In the above-mentioned embodiments, the number of process cartridges for use is four. However, the number is not limited to four, and just needs to be appropriately set according to needs.

Further, the above-mentioned embodiments have been described by taking the integral-type process cartridges as examples of the cartridges. Hence, the embodiments have been described by taking an example where each of the cartridges has the drum grounding electric contact, the developing bias electric contact, and the charging bias electric contact. However, the present invention is not limited to this. For example, in the case where the cartridges are separation-type process cartridges, each of the cartridges has the drum grounding electric contact and the charging bias electric contact. Further, in the case where the cartridges are developing cartridges, each of the cartridges has the developing bias electric contact. The present invention is also applicable to those cartridges. Further, the present invention involves such a case where at least one electric contact among the plurality of cartridge side electric contacts directly contacts with the main body side electric contact.

Further, in the above-mentioned embodiments, a laser beam printer is exemplified as the image forming apparatus. However, the present invention is not limited thereto. For example, another image forming apparatus such as a copying machine and a facsimile machine, or another image forming apparatus such as a composite machine having combined functions thereof may be adopted. By applying the present invention to an image forming apparatus to which the cartridges are detachably mounted, the same effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-249587, filed Sep. 29, 2008, and Japanese Patent Application No. 2009-017478, filed Jan. 29, 2009, which are hereby incorporated by reference herein in their entirety.

The invention claimed is:

1. A color electrophotographic image forming apparatus to which a plurality of cartridges are detachably mounted to form a color image on a recording medium, the color electrophotographic image forming apparatus comprising:

main body side positioning portions provided on a main body of the color electrophotographic image forming apparatus for the plurality of cartridges, respectively;

a cartridge supporting member movable between an inside position in the main body and an outside position that is outside of the main body in a state of detachably supporting the plurality of cartridges having cartridge side electric contacts and cartridge side positioned portions, the cartridge supporting member moving between (i) a first position where the plurality of cartridges are located at an image forming position at which the plurality of cartridges form images at the inside position, and (ii) a second position where the plurality of cartridges are retracted from the first position at the inside position;

a pressing member that presses the plurality of cartridges in association with a movement operation of the cartridge supporting member from the second position to the first position so as to press the cartridge side positioned portions onto the main body side positioning portions;

main body side electric contacts provided on the main body for the plurality of cartridges, respectively, the main body side electric contacts being electrically connected to the cartridge side electric contacts by a movement of the cartridge supporting member from the second position to the first position; and moving members provided in the main body, the moving members supporting the main body side electric contacts and the moving members being moved along a movement direction of the cartridge supporting member by the cartridge supporting member engaging with the moving members in association with the movement of the cartridge supporting member from the second position to the first position so that the moving members are moved to positions in which the main body side electric contacts are electrically connected to the cartridge side electric contacts, wherein, in a state in which the cartridge side positioned portions are pressed against the main body side positioning portions by a pressing force of the pressing member, the cartridge side electric contacts are directly and electrically connected to the main body side electric contacts so that the main body and the plurality of cartridges are electrically connected to each other.

2. A color electrophotographic image forming apparatus according to claim 1, wherein the cartridge side electric contacts (i) are arranged on end surfaces in a longitudinal direction of the plurality of cartridges, (ii) are arranged so as to be located below the cartridge supporting member in a state in which the plurality of cartridges are supported by the cartridge supporting member, and (iii) are arranged, in the longitudinal direction of the plurality of cartridges, in the same positions as positions of the cartridge side positioned portions or in positions inside the positions of the cartridge side positioned portions, which are positioned to the main body side positioning portions in a state in which the plurality of cartridges are located at the image forming position.

3. A color electrophotographic image forming apparatus according to claim 1, wherein the cartridge side electric contacts are located on upper surfaces of the plurality of cartridges in a state in which the plurality of cartridges are supported by the cartridge supporting member, wherein the main body side electric contacts are provided on the pressing member, and wherein the cartridge side electric contacts and the main body side electric contacts are electrically connected to each other in a state in which the pressing member presses the upper surfaces.

4. A color electrophotographic image forming apparatus according to claim 1, wherein the main body further comprises an opening portion through which the cartridge supporting member is moved to an outside of the main body, and an openable and closable member openably and closably provided on the main body for opening and closing the opening portion, wherein, in association with a closing operation of closing the opening portion by the openable and closable member, the cartridge supporting member is moved from the second position to the first position and the pressing member presses the plurality of cartridges so that the cartridge side electric contacts and the main body side electric contacts directly contact each other in a state in which the pressing member presses the plurality of cartridges, and wherein, in association with an opening operation of opening the opening portion by the openable and closable member, the cartridge supporting member is moved from the first position to the second position and the pressing member releases from pressing against the plurality of cartridges so that the cartridge side electric contacts and the main body side electric contacts are spaced from each other.

5. A color electrophotographic image forming apparatus according to claim 1, wherein each of the plurality of cartridges is a process cartridge, which incorporates an electrophotographic photosensitive drum and at least one of a charging means, a developing means, and a cleaning means as process means, integrally into a cartridge that is detachably mounted to the main body, and wherein the cartridge side electric contacts comprise a developing bias electric contact that applies a developing bias from the main body to the developing means, a charging bias electric contact that applies a charging bias from the main body to the charging means, and a drum grounding electric contact that grounds the electrophotographic photosensitive drum to the main body.

6. A color electrophotographic image forming apparatus according to claim 1, wherein the cartridge supporting member is movable from the second position to a third position where the plurality of cartridges are pulled out from the main body and are located at the outside position.

7. A color electrophotographic image forming apparatus according to claim 1, wherein the moving member is rotatably provided in the main body.

* * * * *